US011767701B2

(12) United States Patent
Eccleston

(10) Patent No.: US 11,767,701 B2
(45) Date of Patent: Sep. 26, 2023

(54) HINGED-PANEL OPENING AND CLOSING SYSTEMS AND PROCESSES RELATING THERETO

(71) Applicant: Jon Erwin Eccleston, Oakland, CA (US)

(72) Inventor: Jon Erwin Eccleston, Oakland, CA (US)

(73) Assignee: Jon Erwin Eccleston, Oakland, CA (US)

( * ) Notice: Subject to any disclaimer, the term of this patent is extended or adjusted under 35 U.S.C. 154(b) by 0 days.

(21) Appl. No.: 17/579,632

(22) Filed: Jan. 20, 2022

(65) Prior Publication Data

US 2022/0136306 A1 May 5, 2022

Related U.S. Application Data

(63) Continuation of application No. 16/912,725, filed on Jun. 26, 2020, now Pat. No. 11,261,644.

(51) Int. Cl.
*E05F 15/00* (2015.01)
*E05F 15/614* (2015.01)

(52) U.S. Cl.
CPC ..... *E05F 15/614* (2015.01); *E05Y 2201/434* (2013.01); *E05Y 2900/131* (2013.01)

(58) Field of Classification Search
CPC ..... E05F 15/00; E05F 15/632; E05F 15/614; E05F 15/619; E05F 15/624; E05F 15/622; E05F 15/53; E05F 15/635; E05D 2015/585; E05D 2015/586; E05D 2700/00; E05Y 2900/132; E05Y 2201/434; E05Y 2900/131
USPC ..... 49/280, 287, 501
See application file for complete search history.

(56) References Cited

U.S. PATENT DOCUMENTS

| | | | | |
|---|---|---|---|---|
| 8,779,713 | B2 * | 7/2014 | Burris | E05F 3/224 318/264 |
| 10,348,221 | B1 * | 7/2019 | Wolfe | H02P 3/14 |
| 11,118,392 | B2 * | 9/2021 | McNabb | E05F 15/70 |
| 11,261,635 | B2 * | 3/2022 | Barbon | E05F 1/105 |
| 11,261,644 | B2 * | 3/2022 | Eccleston | E05F 15/627 |
| 2003/0205000 | A1 * | 11/2003 | Pagowski | E05F 15/63 49/341 |
| 2017/0030133 | A1 * | 2/2017 | Elie | B60R 16/03 |
| 2017/0159344 | A1 * | 6/2017 | Langenberg | H02J 50/001 |
| 2022/0186539 | A1 * | 6/2022 | Xue | E05D 5/0246 |

* cited by examiner

*Primary Examiner* — Chi Q Nguyen
(74) *Attorney, Agent, or Firm* — EcoTech Law Group, P.C.

(57) ABSTRACT

A hinged-panel opening and closing system includes: an anchor designed to be located on a hinged panel; a gear motor designed to be located on a supporting structure; and a movement-enabling component capable of angularly displacing the hinged panel relative to a receiving structure. The movement-enabling component includes: (a) a movement-enabling shaft located on the supporting structure and, at one shaft end, coupled to the gear motor; (b) a spindle located on supporting structure and coupled to the movement-enabling shaft; and (c) a linear element attaching, at a first end, to the spindle and attaching, at a second end, to the anchor such that said linear element extends between the spindle and the anchor.

11 Claims, 8 Drawing Sheets

HINGED-PANEL OPENING AND CLOSING SYSTEMS AND PROCESSES RELATING THERETO

RELATED APPLICATION

The present application is a continuation of U.S. patent application Ser. No. 16/912,725 which was filed on Jun. 26, 2020 which is incorporated herein by reference for all purposes.

FIELD

The present teachings generally relate to novel hinged-panel opening/closing systems (e.g., doors and gates opening/closing systems) and processes relating thereto. More particularly, the present teachings relate to improved hinged-panel opening/closing systems and processes relating thereto that use a movement-enabling component to automatically open/close a hinged panel (e.g., door) without manual intervention.

BACKGROUND

People, without a handicap, typically open/close doors and gates (herein referred to as "hinged panels") by applying a force to displace the doors and gates towards/away from their respective door frames and gate frames. Handicapped individuals (e.g., a person relying on a wheelchair for movement), however, may not be capable of applying a requisite force to open/close doors and gates. Such individuals need assistance to carry out the open/close action for entry into/exit from a room or a confined space.

What is, therefore, needed are novel solutions for effectively opening/closing doors and gates for handicapped individuals.

SUMMARY

To this end, the present arrangements and teachings provide improved hinged-panel opening and closing systems (e.g., doors and gates opening and closing systems) and methods relating thereto. The systems and methods of the present arrangements and teachings allow rotational displacement of doors and gates towards/away from a receiving structure. Opposite to the receiving structure is a supporting structure that facilitates support of the doors and gates.

In one aspect, the present arrangements provide hinged-panel opening and closing systems. An exemplar of such hinged-panel opening and closing systems includes: (i) a gear motor; (ii) an anchor; and (iii) a movement-enabling component. In this example, the gear motor is designed to be located on a supporting structure and the anchor is designed to be located on a hinged panel. The hinged panel, which includes a proximate end and a distal end, is configured to be disposed between a receiving structure and the supporting structure. In this configuration, the hinged panel is capable of rotating about one or more hinges, located at or near the proximate end, to displace the distal end relative to the receiving structure. The movement-enabling component is coupled to both the supporting structure and the hinged panel. Moreover, the movement-enabling component is capable of displacing the distal end of the hinged panel relative to the receiving structure. Preferably, the hinged panel is a gate or door.

The movement-enabling component includes: (iv) a movement-enabling shaft; (v) a spindle; and (vi) a linear element. The movement-enabling shaft is designed to be disposed on the supporting structure and is operationally coupled, at one end of movement-enabling shaft, to the gear motor. In one operative state, the gear motor enables an opening motion of the movement-enabling shaft.

The spindle is also designed to be located on the supporting structure and is operationally coupled to another movement-enabling shaft end. The opening motion of the movement-enabling shaft is conveyed, through another end of the movement-enabling shaft, to produce one operative of state of the spindle that generates an operative torque.

The linear element attaches, at a first linear end, to the spindle and attaches, at a second linear end, to the anchor such that the linear element extends by an adjustable length between the spindle and the anchor. The linear element rotationally, and not linearly, displaces the anchor.

In the presence of the operative torque, the linear element wraps around the spindle to reduce the adjustable length of the linear element extending between the spindle and the anchor. This results in an opening tension force acting upon the linear element that rotationally displaces the anchor and is designed to displace the distal end of the hinged panel away from the receiving structure in a manner that produces an opening motion of the hinged panel.

When the spindle receives an external force not resulting from the operative state of the gear motor, the spindle generates an opposing torque effective in a direction opposite to the operative torque. In the presence of the opposing torque, the linear element is prevented from wrapping around the spindle or unwraps from the spindle. If the linear element unwraps from the spindle, the adjustable length of the linear element, between the spindle and the anchor, increases. Moreover, the opposing torque results in a closing force, acting on the linear element, that allows rotational displacement of the anchor. The closing force is also designed to allow displacement of the distal end towards the receiving structure to produce a closing motion of the hinged panel.

During a non-operative state of the gear motor, however, when another type of external opening force acts upon the anchor, the anchor undergoes rotational displacement causing the linear element to unwrap from the spindle without transferring the external opening force to the spindle. Thus, when another type of external opening force acts upon the anchor, the movement-enabling component and the gear motor are designed to not interfere with the opening motion of the hinged panel.

In one implementation of the present arrangements, the hinged panel is a gate or door. In another implementation of the present arrangements, the external force is produced by presence of an impediment to rotational displacement of the anchor. In yet another implementation of the present arrangements, the spindle is a capstan spindle and the linear element is a capstan strap.

The anchor, in one embodiment of the present arrangements, has defined thereon an arced surface profile that extends an arced length spanning from one end to another end. The linear element is disposed adjacent to the arced surface profile and extends an extending length that is equivalent to the arced length. The spindle, during one operative state, rotates and the extending length of the linear element wraps or unwraps around the spindle, which angularly displaces the anchor by about 90 degrees.

In one embodiment of the present arrangements, the hinged-panel opening and closing systems further includes one or more hinges disposed between the hinged panel and the supporting structure.

In another embodiment of the present arrangements, the hinged-panel opening and closing systems further includes a closing mechanism for applying a closing external torque on the spindle to unwrap the linear element from the spindle, which increases the adjustable length of the linear element between the spindle and the anchor. A resulting closing force allows rotational displacement of the anchor and is designed to allow displacement of the distal end towards the receiving structure and produce the closing motion. In one implementation of the present arrangements, the closing mechanism is a spring this is designed to be coupled, at one spring end, to the hinged door and, at another spring end, to the supporting structure.

In yet another embodiment of the present arrangements, the hinged-panel opening and closing systems further includes a circuit coupled to the gear motor at one end and coupled to a power supply at another end. The circuit is configured to measure draw of current by the gear motor during operation and depending on value of draw of current measured, the circuit directs voltage to enable rotational displacement of the anchor in one direction or in a reverse direction.

In addition to the circuit, the hinged-panel opening and closing system, in one implementation of the present arrangements, further includes a memory for storing the values of draw current measured and a clock or a timer that operates in conjunction with the circuit to enable the circuit to direct voltage or current, to enable rotational displacement of the anchor in the one direction or in the reverse direction, for a specified duration.

In yet another embodiment of the present arrangements, the hinged-panel opening and closing systems further includes a gear motor shaft that is coupled, at one end, to the gear motor and is coupled, at another end, to the movement-enabling shaft. The gear motor operates through the gear motor shaft to enable the opening motion of the movement-enabling shaft. Preferably, in presence of the operative torque, the gear motor shaft and the movement-enabling shaft rotate in a same direction.

The hinged-panel opening and closing systems, in yet another implementation of the present arrangements, further includes a first frictional surface and a second friction surface. The first frictional surface is coupled to the gear motor shaft and the rotation motion of the gear motor shaft generates an imparting torque at the first frictional surface. The second frictional surface makes a frictional contact with the first frictional surface and is coupled to the movement-enabling component. The imparting torque received at the first frictional surface is restricted by presence of the frictional contact to produce a restricted torque at the second frictional surface. The restricted torque is conveyed to the movement-enabling shaft.

In the presence of an opposing torque that is equal to or greater than the restricted torque, the gear motor shaft rotates in a first direction and the movement-enabling shaft does not rotate or rotates in a second direction that is opposite to the first direction.

The first frictional surface, in one embodiment of the present arrangements, is a protruding component that includes a contact surface. The second frictional surface is a receiving component that includes a conical-shaped cavity having a complementary surface. At least a portion of the protruding component occupies the conical-shaped cavity and the contact surface and the complementary surface contact to form the frictional contact. The protruding component is coupled to the gear motor shaft and the receiving component is coupled to the movement-enabling shaft. An outside portion of the movement-enabling shaft includes the spindle.

The first frictional surface, in another embodiment of the present arrangements, is a supporting disc that includes a contact surface. The second frictional surface is a rotating disc that includes a complementary surface. The rotating disc is coupled to the gear motor shaft and the supporting disc is coupled to the movement-enabling shaft. The contact surface and the complementary surface contact to form the frictional contact.

Another exemplar of the present hinged-panel opening and closing systems includes: (i) a gear motor; (ii) an anchor; and (iii) a movement-enabling component, however, the gear motor is designed to be located on a hinged panel and the anchor is designed to be located on a supporting structure. The hinged panel, which includes a proximate end and a distal end, is configured to be disposed between a receiving structure and the supporting structure and is capable of rotating about one or more hinges, located at or near the proximate end, to displace the distal end relative to the receiving structure. The movement-enabling component is coupled to both the supporting structure and the hinged panel. Moreover, the movement-enabling component is capable of displacing the distal end of the hinged panel relative to the receiving structure.

The movement-enabling component includes: (iv) a movement-enabling shaft; (v) a spindle; and (vi) a linear element. The movement-enabling shaft is designed to be disposed on the hinged panel and is operationally coupled, at one end of movement-enabling shaft, to the gear motor. In one operative state, the gear motor enables an opening motion of the movement-enabling shaft.

In this example, the spindle is also designed to be located on the hinged panel. The spindle is operationally coupled, at another shaft end, to the movement-enabling shaft. The opening motion of the movement-enabling shaft is conveyed, through another end of the movement-enabling shaft, to produce one operative of state of the spindle that generates an operative torque.

The linear element attaches, at a first linear end, to the spindle and attaches, at a second linear end, to the anchor such that the linear element extends by an adjustable length between the spindle and the anchor. The linear element rotationally, and not linearly, displaces gear motor.

In the presence of the operative torque, the linear element wraps around the spindle to reduce the adjustable length of the linear element extending between the spindle and the anchor. This results in an opening tension force acting upon the linear element that rotationally displaces the gear motor and is designed to displace the distal end of the hinged panel away from the receiving structure in a manner that produces an opening motion of the hinged panel.

When the spindle receives an external force not resulting from the operative state of the gear motor, the spindle generates an opposing torque effective in a direction opposite to the operative torque. In the presence of the opposing torque, the linear element is prevented from wrapping around the spindle or unwraps from the spindle. If the linear element unwraps from the spindle, the adjustable length of the linear element, between the spindle and the anchor, increases and resulting in a closing force that allows rotational displacement of the gear motor. The closing force is also designed to allow displacement of the distal end towards the receiving structure to produce the closing motion of the hinged panel.

In one embodiment of the present arrangements, hinged-panel opening and closing systems further includes a circuit; and a switch. The circuit may be coupled to the gear motor at one end, and coupled to a power supply at another end. In this configuration, the circuit is configured for measuring draw of current by the gear motor during operation of the gear motor and depending on value of draw of current measured, the circuit directs voltage and current drawn to enable rotational displacement of the gear motor in one direction or in a reverse direction. The switch is, preferably, coupled to the circuit and when contacted or pressed, instructs the circuit to cease operation of the gear motor.

In another aspect, the present teachings also provide methods of pivoting a hinged panel around hinges. In one implementation of the present teachings, the method includes: (i) powering a gear motor on a supporting structure; (ii) placing into an opening motion, using the gear motor, a movement-enabling shaft that is operationally coupled to the gear motor; (iii) generating, using the opening motion, an operative torque at a spindle that coupled to the movement-enabling shaft; (iv) wrapping around the spindle, using the operative torque, a linear element and producing an opening tension force along the linear element; (v) angularly displacing the anchor, using the opening tension force, wherein the anchor is secured on the hinged panel that is disposed between the supporting structure and a receiving structure; and (vi) pivoting, contemporaneously with the angularly displacing the anchor, the hinged panel around one or more hinges disposed between and coupled to the supporting structure and the hinged panel to produce an opening motion of the hinged panel such that the hinged panel displaces away from the receiving structure.

The methods of pivoting a hinged panel around hinges, in this aspect of the present teachings, further includes receiving, at a signal receiver that is coupled to the gear motor, an initializing signal to initiate powering of the gear motor. In one embodiment of the present teachings, powering the gear motor includes distributing, using a circuit, an opening voltage from the power supply to the gear motor.

In certain embodiments of the present teachings, wrapping around the spindle further includes wrapping an extending length of the linear element around the spindle to angularly displace the anchor by about 90 degrees.

In one embodiment of the present teachings, the methods of pivoting a hinged panel around hinges further includes: (a) applying, using a closing mechanism, a closing external torque on the spindle; (b) unwrapping around the spindle, under action of the closing external torque, the linear element and thereby increasing the adjustable length of the linear element between the spindle and the anchor and resulting in a closing force; and (c) rotationally displacing the anchor, under action of the closing force, such that the distal end of the hinged panel rotationally displaces towards the receiving structure to produce a closing motion of the hinged panel.

In another embodiment to the present teachings, placing the movement-enabling shaft into the opening motion further includes placing into motion a gear motor shaft, coupled, on one end, to the gear motor and coupled, at another end, to the movement-enabling shaft such that the gear motor operates through the gear motor shaft to enable placing the movement-enabling shaft into the opening motion.

In one implementation of the present teachings, the methods of pivoting a hinged panel around hinges further includes: (a) receiving, at the spindle, an external force not resulting from the gear motor; (b) translating the external force, received at the spindle, to an opposing torque operating in a direction opposite to the operative torque; and (c) if magnitude of the opposing torque is greater than or equal to the operative torque, impeding the opening motion or performing a closing motion of the movement-enabling shaft, wherein the closing motion of the movement-enabling shaft is in a direction opposite to the opening motion of the movement-enabling shaft, and the closing motion of the movement-enabling shaft allows the hinged panel to displace towards the receiving structure.

The step of impeding the opening motion of the movement-enabling shaft, in one embodiment of the present teachings, includes using a physical hinged-panel displacement regulator and further includes: (a) rotating, using the motion of the gear motor shaft, a first friction surface, wherein the gear motor shaft is coupled to the first friction surface; (b) generating, from the rotating, an imparting torque at the first frictional surface; (c) creating a frictional contact between the first frictional surface and a second frictional surface that is coupled to movement-enabling component; (d) restricting, using the frictional contact, the imparting torque of the first frictional surface to produce a restricted torque at the second frictional surface; and (e) translating the restricted torque to the opening motion the movement-enabling shaft. In the presence of the opposing torque that is equal to or greater than the restricted torque, the gear motor shaft rotates in a first direction and the movement-enabling shaft does not rotate or rotates in a second direction that is opposite to the first direction.

The step of the performing a closing motion of the movement-enabling shaft, in one embodiment of the present teachings, includes using an electronic hinged-panel displacement regulator and further comprising: (a) measuring, using a circuit, an amount of current drawn by the gear motor; (b) comparing, using the circuit, the amount of current drawn to a predefined value of amount of current drawn for a predefined value of time duration; and (c) directing, using the circuit, a closing voltage to the gear motor, if the amount of current drawn equals to or exceeds the predefined value of amount of current drawn for the predetermined value of time duration.

The closing voltage may be a magnitude of voltage that is applied to the gear motor to effect the closing motion of the movement-enabling shaft. In a preferred embodiment of the present teachings, directing the closing voltage to the gear motor is carried out for a predefined duration of closing time, which is value of time duration taken by the hinged panel to be disposed in a same plane as the receiving structure.

In yet another embodiment of the present teachings, the methods of pivoting a hinged panel includes instructing the circuit, using a switch, to cease operation of the gear motor when the switch is contacted or pressed.

The construction and method of operation of the invention, however, together with additional objects and advantages thereof, will be best understood from the following descriptions of specific embodiments when read in connection with the accompanying figures.

DETAILED DESCRIPTION OF THE PREFERRED EMBODIMENTS

Figure 1A:
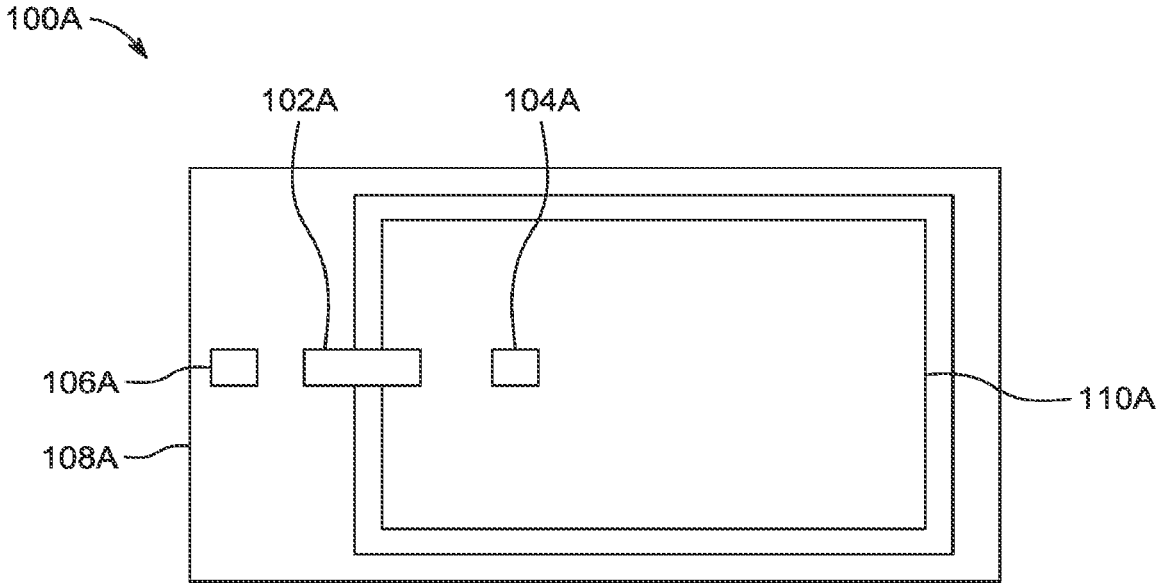
FIG. 1A shows a frontal view of a hinged-panel opening and closing system, according to one embodiment of the present arrangements, that includes a movement-enabling component, an anchor, and a gear motor, wherein the gear motor is secured to a supporting structure, the anchor is secured to the hinged panel, and the movement-enabling component is coupled to both the gear motor and the anchor, and the movement-enabling component enables the hinged panel to pivot, e.g., around a hinged connection between the supporting structure and the hinged panel.

In the following description, numerous specific details are set forth in order to provide a thorough understanding of the present teachings and arrangements. It will be apparent, however, to one skilled in the art that the present teachings and arrangements may be practiced without limitation to some or all of these specific details. In other instances, well-known process steps have not been described in detail in order to not unnecessarily obscure the present teachings and arrangements.

The present arrangements and teachings relate to hinged-panel opening and closing systems and methods relating thereto. The hinged-panel opening and closing systems enable displacement of hinged panels, such as doors and gates, during an opening and/or closing motion.

In the example of a door, the present door opening and closing systems and methods allow for automatic door opening and closing. Such systems and methods are desired in many applications, but particularly in those where the interacting individual is disabled or her/his body parts (e.g., hands) are not in a position to open and/or close the door.

Typically, a door opens and/or closes as it pivots around hinges, which couple the door (at a hinge end of the door which is herein also referred to as a "proximate end" of the door) to a supporting structure. The supporting structure is part of a doorframe that is at least partially disposed around the door. According to the present arrangements, the doorframe design, need not necessarily, but may represent a unitary structure that includes a receiving structure that is disposed on the opposite side of the supporting structure. Thus, in this arrangement, the door is disposed between the supporting structure and the receiving structure. In an operational state of the door opening and closing systems, a far end (herein also referred to as a "distal end") of the door displaces towards/away from the receiving structure, depending on whether the intention is to close or open the door (relative to the door frame).

The door opening and closing systems of the present arrangement include a gear motor, an anchor, and a movement-enabling component. In certain embodiments of the present arrangements, the gear motor is disposed on the doorframe and the anchor is disposed on or near the door. In alternative embodiments of the present arrangements, the gear motor is disposed on or near the door and the anchor is disposed on the doorframe.

Regardless of the location of these components, of particular relevance to the door opening and/or closing is the movement-enabling component, which includes a movement-enabling shaft, a spindle, and a linear element. The linear element linearly extends between the spindle and the anchor connecting the door to the supporting structure (which may be part of the doorframe). In this configuration, the linear element is capable of wrapping or unwrapping around the spindle.

When a door is opened automatically using, for example, a remote device, the gear motor rotates and so does the movement-enabling shaft that is coupled to it. The rotational motion produces an operative torque at the spindle, which is connected to the movement-enabling shaft. In the presence of the spindle's operative torque, the linear element wraps around the spindle, resulting in an opening tension force acting upon the linear element. This opening tension force rotationally displaces the anchor, which in turn, displaces the far end of the door away from the receiving structure to produce a door opening motion.

The present teachings recognize that, during a door opening motion using conventional door opening assemblies, when a significant external force obstructs the door (e.g., someone kicks the door or an object impedes or blocks the opening and/or closing motion door), the gear motor, among other things, is damaged. Specifically, in the absence of any safety provisions, the gear motor is forced suddenly generate a reduced rate of rotational motion or the gear motor stalls, which overheats the motor, causing it to burnout.

However, the present arrangements described below, incorporate novel safety systems (e.g., an electronic hinged-panel displacement regulator and a physical hinged-panel displacement regulator) that, among other things, prevent such gear motor damage. According to the present arrangements, a damaging external force received at the door is conveyed, via the linear element, to the spindle, which generates an opposing torque. The spindle's opposing torque is effective in a direction opposite to the spindle's operative torque. When the opposing torque produced by the configuration of the present arrangements is above a predefined threshold value, the present arrangements described below prevents the linear element from wrapping around the spindle or unwrapping from the spindle. As will be explained below, the spindle design, in one implementation of the present arrangements, generates a closing force that acts on the linear element, which allows the rotational displacement of the anchor and allows displacement of the far end of the door towards the receiving structure to produce a closing motion of the door. Thus, the present arrangements and methods, not only allow for effective door opening motion, but also include provisions to safeguard against damaging external forces received during the door opening motion.

Although the above advantages and features are described in the context of a door, these equally extend to the example of a gate and to a hinged panel of any type. As a result, the gate frames, hinged panel frames, gate opening and closing systems and methods, and hinged-panel opening and closing systems and methods also enjoy the advantages described herein.

By way of example, FIG. 1A shows a hinged-panel opening and closing system 100A, according to one embodiment of the present arrangements, that includes a movement-enabling component 102A, an anchor 104A, and a gear motor 106A. Gear motor 106A is disposed on supporting structure 108A and an anchor 104A is disposed on hinged panel 110A. Movement-enabling component 102A is disposed on both supporting structure 108A and hinged panel 110A. As mentioned before, supporting structure 108A is coupled, for example, via a hinged connection, to hinged panel 110A. In this configuration, movement-enabling component 102A enables hinged panel 110A to pivot, e.g., around the hinged connection. During this pivoting action, hinged panel 110A is mechanically supported by supporting structure 108A.

Figure 1B:
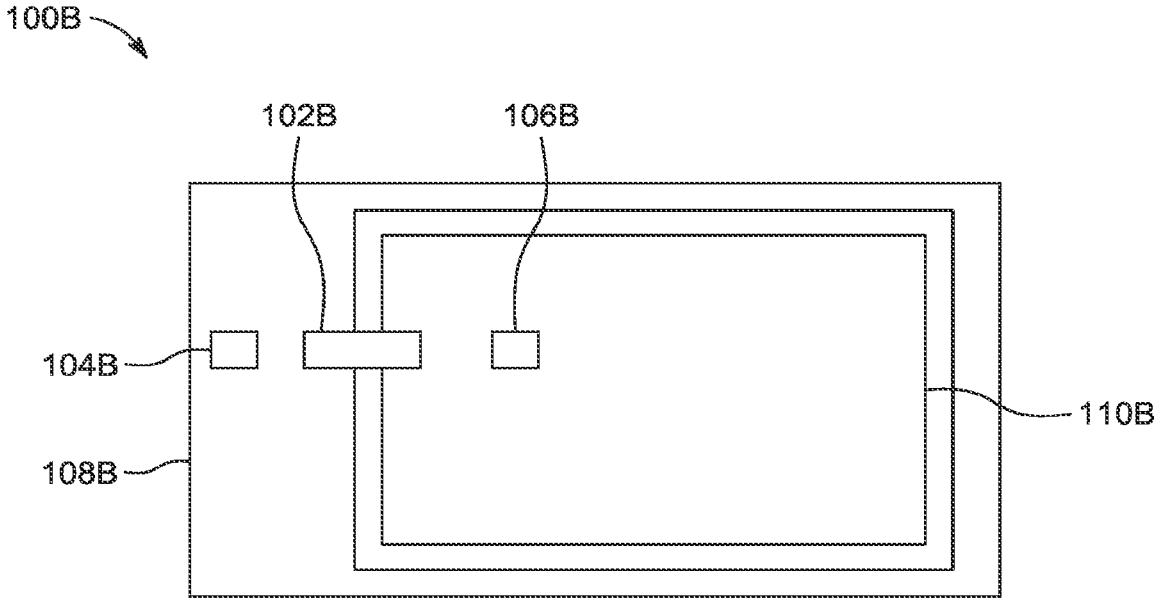
FIG. 1B shows a frontal view of a hinged-panel opening and closing system, according to another embodiment of the present teachings, that is substantially similar to hinged-panel opening and closing system of FIG. 1A, except the anchor is coupled to the supporting structure, the gear motor is coupled to the hinged panel, and the movement-enabling component enables the hinged panel to pivot, e.g., around a hinged connection between the supporting structure and the hinged panel.

A hinged-panel opening and closing system 100B of FIG. 1B is substantially similar to FIG. 1A except that the dispositions of gear motor 106B and anchor 104B are different relative to supporting structure 108B and hinged panel 110B (i.e., an anchor 104B is disposed on supporting structure 108B and a gear motor 106B is disposed on hinged panel 110B). Despite of this change in placement of gear motor 106B and anchor 104B, movement-enabling component 102B remains coupled to both gear motor 106B and anchor 104B, as it was in FIG. 1A. In the assembled configuration of FIG. 1B, movement-enabling component 102B enables hinged panel 110B to pivot, e.g., around the hinged connection, in the same manner as hinged panel 110A of FIG. 1A. Thus, regardless of the disposition of the gear motor and the anchor relative to the supporting structure and the hinged panel, the hinged-panel opening and closing systems of the present arrangements allow the hinged panel to pivot around a hinged connection that couples the hinged panel to the supporting structure.

Figure 2:
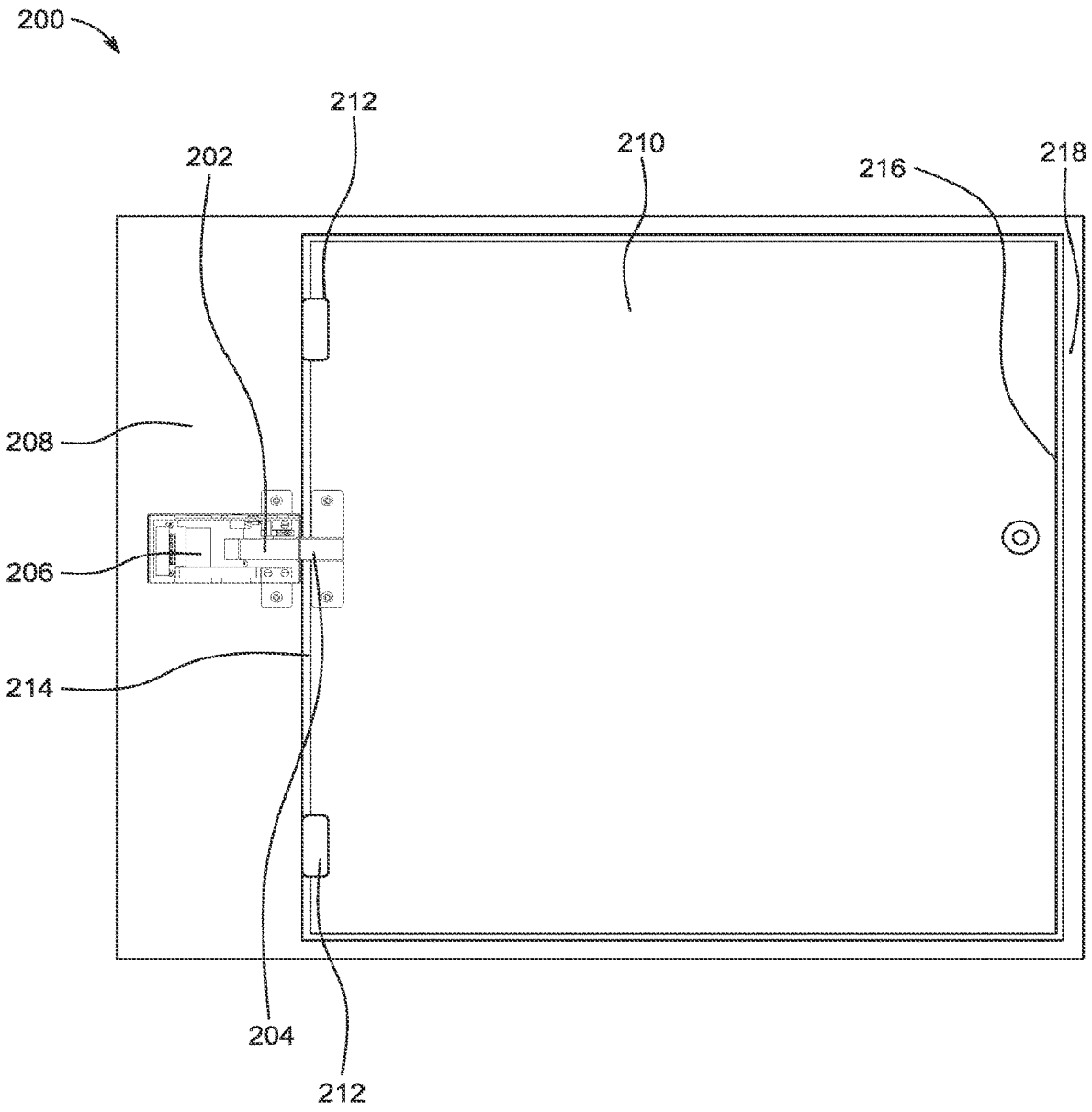
FIG. 2 shows a frontal view of the hinged-panel opening and closing system 200 of FIG. 1A, according to one embodiment of the present arrangements, that angularly displaces, using hinges that are coupled to a supporting structure and a hinged panel, a distal end of a hinged panel towards or away from to a receiving structure, wherein the receiving structure is disposed on the opposite side of the supporting structure.

FIG. 2 shows a hinged-panel opening and closing system 200, according to one embodiment of the present arrangements, that is substantially similar to hinged-panel opening and closing system 100A of FIG. 1A. Hinged-panel opening and closing system 200 includes a movement-enabling component 202, an anchor 204, and a gear motor 206, which are substantially similar to their counterparts in FIG. 1A (i.e., movement-enabling component 102A, an anchor 104A, and gear motor 106A, respectively). As discussed above, movement-enabling component 202 further includes a movement-enabling shaft, a spindle, and a linear element, each of which will be discussed in greater detail in FIG. 3 (i.e., linear element 322, a spindle 320, and a movement-enabling shaft 326, respectively).

Hinged panel 210, which includes a proximate end 214 and a distal end 216, is disposed between a supporting structure 208 and a receiving structure 218. Together, supporting structure 208 and the receiving structure 218 define an opening that receives hinged panel 210. One or more hinges 212 are coupled to both supporting structure 208 and proximate end 214 of hinged panel 210 and allow rotational displacement of distal end 216 of hinged panel 210 relative to receiving structure 218. In other words, hinged panel 210 rotates about an axis of rotation that extends through one or more hinges 212 to at least partially open or close the opening defined by supporting structure 208 and receiving structure 218.

To enable rotational displacement of hinged panel 210, hinged-panel opening and closing system 200 is coupled to supporting structure 208 at, or near, the proximate end of hinged panel 210. In this exemplar embodiment, gear motor 206 is disposed on supporting structure 208, anchor 204 is disposed on hinged panel 210, and movement-enabling component 202 is coupled to both gear motor 206 and anchor 204. Movement-enabling component 202, during one operational state of hinged-panel opening and closing system 200, enables displacement of distal end 216 of hinged panel 210 relative to receiving structure 218. In a preferred embodiment of the present arrangements, hinged-panel opening and closing system 200 uses two or more hinges 212 to effect the hinged-panel opening or closing motions.

In another embodiment of the present arrangements, discussed above in reference to FIG. 1B, anchor 204 is disposed on supporting structure 208 and gear motor 206 is disposed on hinged panel 210. In this embodiment of the present arrangements, hinged-panel opening and closing system 200 will operate in a manner that is substantially similar to hinged-panel opening and closing system 100B of FIG. 1B. In particular, movement-enabling component 202, during one operational state of hinged-panel opening and closing system 200, displaces the distal end of hinged panel 210 relative to receiving structure 218.

In yet another embodiment of the present arrangements, a closing mechanism is coupled to supporting structure 208 and hinged panel 210. If distal end 216 of hinged panel 210 is displaced away from receiving structure 218, the closing mechanism generates a closing motion of hinged panel 210 to return distal end 216 to a linear plane that is substantially the same as a linear plane of receiving structure 218 (which is herein referred to as the "closed position"). The closing mechanism may be any mechanism that returns distal end 216 the closed position. By way of example, the closing mechanism is a spring hinge, a hydraulic door closer, or torsion spring.

Figure 3:
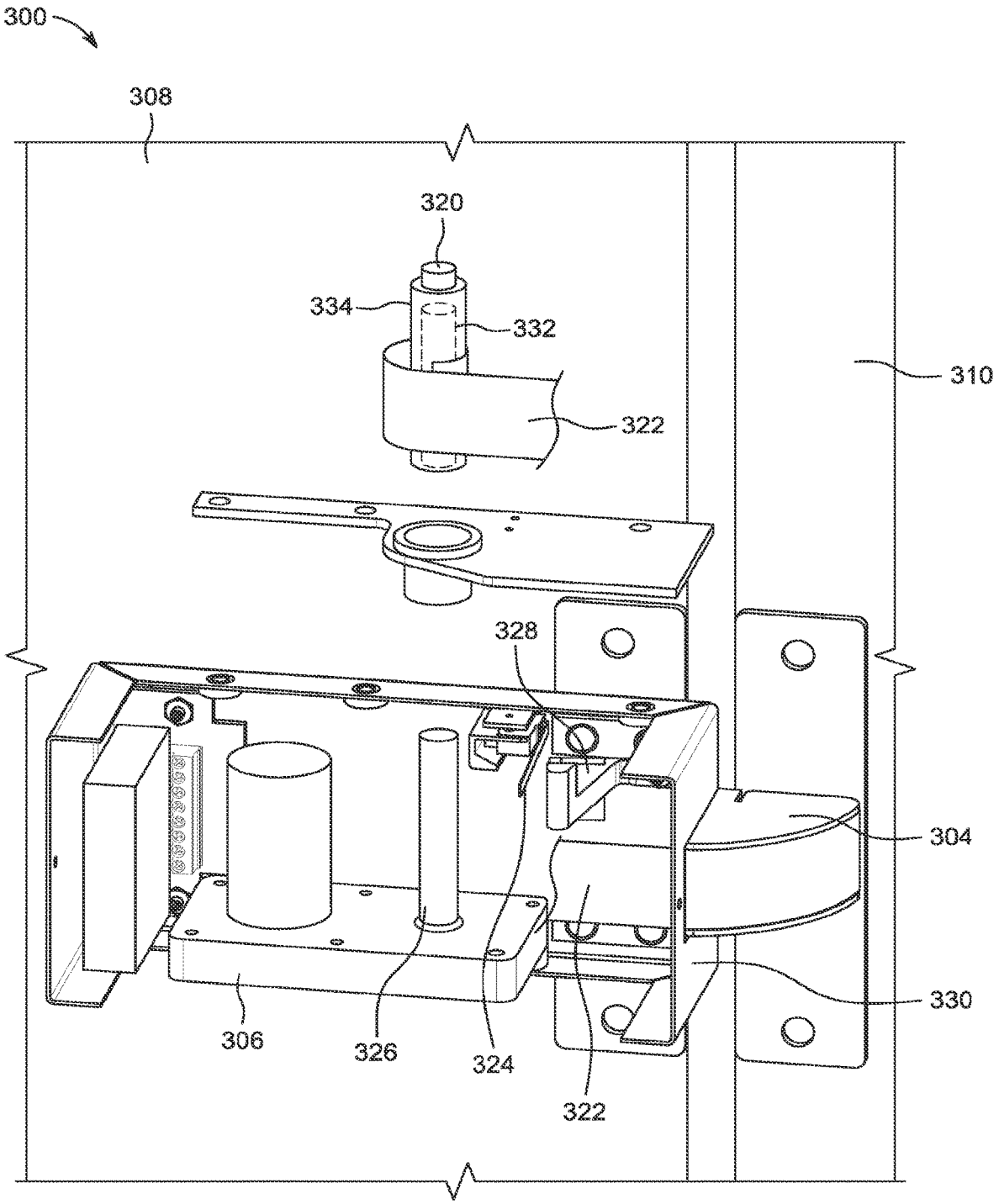
FIG. 3 shows a detailed frontal view of the salient components involved in the design of the hinged-panel opening and closing system of FIG. 2.

FIG. 3 shows, in greater detail, a hinged-panel opening and closing system 300, according to one embodiment of the present arrangements, that is substantially similar to hinged-panel opening and closing system 200 of FIG. 2. Hinged-panel opening and closing system 300, includes a gear motor 306, disposed on a supporting structure 308, an anchor 304, disposed on a hinged panel 310, and a movement-enabling component, which includes a linear element 322, a spindle 320, and a movement-enabling shaft 326. Supporting structure 308, hinged panel 310, gear motor 306, anchor 304, and the movement-enabling component are substantially similar to their counterparts in FIG. 2 (i.e., supporting structure 208, and hinged panel 210, movement-enabling component 202, anchor 204, gear motor 206, respectively).

One end of movement-enabling shaft 326 is coupled to gear motor 306. Another end of movement-enabling shaft 326 is coupled to spindle 320. More particularly in this embodiment of the present arrangements, a first spindle end of spindle 320 has defined therein a spindle aperture 332 that extends into spindle 320. Spindle aperture 332 receives another end of movement-enabling shaft 326 to couple spindle 320 to movement-enabling shaft 326.

An external surface 334 at least partially surrounds spindle 320. An end of linear element 322 is coupled to external surface 334 and in a preferred embodiment of the present arrangements, an initial portion of linear element is wrapped around external surface 334. Another end of linear element 322 is coupled to anchor 304. Thus, linear element 322 extends by an adjustable length between spindle 320 and anchor 304.

During different operational states of gear motor 306, gear motor 306 enables movement-enabling shaft 326 to perform an opening motion and/or a closing motion. The opening motion and/or closing motion of movement-enabling shaft 326 is conveyed, through another end of movement-enabling shaft 326, to spindle 320.

The opening motion of spindle 320, in one embodiment of the present arrangements, generates an operative torque. The operative torque of spindle 320 causes linear element 322 to wrap around external surface 334 of spindle 320, reducing the adjustable length of linear element 322 between spindle 320 and anchor 304. Moreover, the wrapping of linear element 322, around spindle 320, creates an opening tension force that acts on linear element 322. The opening tension force rotationally, and not linearly, displaces anchor 304. The rotational displacement of anchor 304 displaces the distal end of hinged panel 310 away from a receiving structure to produce an opening motion of the hinged panel.

The closing motion of spindle 320, in another embodiment of the present arrangements, generates a closing torque. The closing torque causes, in one embodiment of the present arrangements, linear element 322 to unwrap around external surface 334 of spindle 320. The unwrapped linear element 322 increases the adjustable length of linear element between spindle 320 and anchor 204. The increased adjustable length allows rotational displacement of the distal end of hinged panel 310 towards the receiving structure to produce a closing motion of the hinged panel.

In one embodiment of the present arrangements, the closing motion of spindle 320 is carried out when spindle 320 receives an external force that is not from gear motor 306. The external force generates an opposing torque and, as will be described in greater detail below, if the opposing torque exceeds a predetermined threshold, gear motor 306 will enable the closing motion of spindle 320.

Gear motor 306 may be any motor that enables movement-enabling shaft 326 to perform an opening motion and/or a closing motion. Preferably, the opening motion and/or the closing motion is a rotational motion of hinged panel 310 around the above-described hinged connection, and the closing motion is a rotational motion that is in an opposite direction of the opening motion.

In a preferred embodiment of the present arrangements, gear motor 306 is a direct current ("DC") motor. By way of example, gear motor 306 may be any DC motor chosen from a group comprising brushed motor, brushless motor, stepper motor, permanent magnet motor, shunt wound motor, series-wound motor, and compound wound motor.

Gear motor 306 receives an opening voltage to generate, at movement-enabling shaft 326, an opening motion and receives a closing voltage to generate, at movement-enabling shaft 326, a closing motion. Gear motor 306 has nominal voltage value, which is an opening voltage and/or closing voltage of gear motor 306 during operative state of the present arrangements, that ranges from between about 0.5 volts to about 250 volts. In a preferred embodiment of the present arrangements, the nominal voltage value ranges from about 5 volts to about 50 volts. In a more preferred embodiment of the present arrangements, the nominal voltage value ranges from about 10 volts to about 30 volts. In one embodiment of the present teachings, the nominal opening voltage is substantially similar to the nominal closing voltage and in another embodiment of the present teachings, the nominal opening voltage is different from the nominal closing voltage. In a preferred embodiment of the present teachings, the opening voltage and the closing voltage is about 25 volts.

Gear motor 306, in another embodiment of the present arrangements, receives the opening voltage and/or the closing voltage for a predefined duration of time. A predefined duration of opening time value for the opening voltage may be any duration of time to complete displacement of a distal end of hinged panel 310 relative to the receiving structure. A predefined duration of closing time value for the closing voltage may be any duration of time to return hinged panel 310 to a closed position. On one embodiment of the present arrangements, the predefined duration of opening time and/or closing time value ranges from about 1 seconds to about 60 seconds, preferably ranges from about 2 seconds to about 15 seconds, and more preferably ranges from about 4 seconds to about 5 seconds. The opening duration of time, in one embodiment of the present arrangements, is substantially similar to the closing duration of time.

Gear motor 306, in one implementation of the present arrangements, has a stall torque value, which is a maximum torque value produced by gear motor 306 when running at the gear motor 306's nominal voltage. At the stall torque, an output rotational speed of gear motor 306 is zero rotations per second. In one embodiment of the present arrangements the stall torque value ranges from about 0.5 ounce-inches to about 300 ounce-inches. In a preferred embodiment of the present arrangements, the stall torque value ranges from about 3 ounce-inches to about 75 ounce-inches. In a more preferred embodiment of the present arrangements, the stall torque value ranges from about 5 ounce-inches to about 50 ounce-inches.

Gear motor 306 enables movement-enabling shaft 326 to rotate, in an opening motion and/or a closing motion, at a rotations per minute ("RPM") value that ranges from about 1 RPM to about 50 RPM. In a preferred embodiment of the present arrangements, movement-enabling shaft 326 rotates at an RPM value that ranges from about 10 RPM to about 30 RPM. In a more preferred embodiment of the present arrangements, movement-enabling shaft 326 rotates at an RPM value that ranges from about 15 RPM to about 25 RPM. The DC motor, in one implementation of the present arrangements, rotates in an opening motion and/or a closing motion of about 17 RPM.

Movement-enabling shaft 326 may be any shaft that is coupled to gear motor 306 and spindle 320 and is capable of conveying, to spindle 320, the opening motion and/or a closing motion. Movement-enabling shaft 326 extends an extending distance from gear motor 306 to enable coupling to spindle 320. The extending distance may be any distance that allows movement-enabling shaft to couple to spindle 320. In one embodiment of the present arrangements, movement-enabling shaft 326 has an extending distance value that ranges from about 0.125 inches to about 5 inches, preferably ranges from about 0.25 inches to about 3 inches, and more preferably ranges from about 0.375 inches to about 1 inch.

A cross-section of movement-enabling shaft 326 may be of any shape. By way of example, movement-enabling shaft 326 may be a spline, a polygon (e.g., a square shaft), a conic (e.g., a circular shaft), or a combination of a polygon and a conic (e.g., a D-shaped shaft that includes a circular portion and a linear chord that extends from one end of a circular portion to another end of the circular portion to form a shape that is substantially similar in appearance to a capital letter "D."). In a preferred embodiment of the present arrangements, the cross-sectional shape of movement-enabling shaft 326 is a D-shaped.

In one embodiment of the present arrangements, movement-enabling shaft 326 has cross-sectional diameter value that ranges from about 0.125 inches to about 1 inch. In a preferred embodiment of the present arrangements, movement-enabling shaft 326 has a diameter value that ranges from about 0.1875 inches to about 0.375 inches. In a more preferred embodiment of the present arrangements, movement-enabling shaft 326 has a diameter value that ranges from about 0.2 inches to about 0.3 inches.

Moreover, a width of movement-enabling shaft 326 may change along the extending length and is capable of being implemented in different shapes By way of example, movement-enabling shaft 326 is of a shape that is a polyhedral (e.g., a cube or a pyramid), an ellipsoid (e.g., a sphere), a cylinder, or a cone. In a preferred embodiment of the present arrangements, movement-enabling shaft is cylindrically shaped along its extending length.

Spindle 320 may be any component that is coupled to both movement-enabling shaft 326 and linear element 322 and is capable generating, from the opening motion, an operative torque and generating, from the closing motion, a closing torque. In a preferred embodiment of the present arrangements, spindle 320 is a cylindrically shaped along its extending length. Spindle 320, in one embodiment of the present arrangements, has an external diameter value that ranges from about 0.125 inches to about 5 inches. In a preferred embodiment of the present arrangements, spindle 320 has an external diameter value that ranges from about 0.1875 inches to about 1 inch. In a more preferred embodiment of the present arrangements, spindle 320 has an external diameter value that ranges from about 0.25 inches to about 0.75 inches.

Moreover, to allow coupling of spindle aperture 332 to movement-enabling shaft 326, a cross-sectional shape of spindle aperture 332 is complementary to the cross-sectional shape of movement-enabling shaft 326. In a preferred embodiment of the present arrangements, the cross-sectional shape of spindle aperture 332 and movement-enabling shaft 326 is a cylinder. Spindle aperture 332, in one embodiment of the present arrangements has an internal diameter value that ranges from about 0.125 inches to about 1 inch. In a preferred embodiment of the present arrangements, spindle aperture 332 has an internal diameter value that ranges from about 0.1875 inches to about 0.375 inches. In a more preferred embodiment of the present arrangements, spindle aperture 332 has an internal diameter value that ranges from about 0.2 inches to about 0.3 inches.

The present teachings recognize that movement-enabling shaft 326 may be coupled to spindle 320 using various components or methods. By way of example, coupling of movement-enabling shaft 326 and spindle 320 may be performed by press fitting movement-enabling shaft 326 into spindle 320, by applying an adhesive between movement-enabling shaft 326 and spindle 320, by threading spindle 320 onto movement-enabling shaft 326, and by securing movement-enabling shaft 326 to spindle 320 with one or more fasteners.

Spindle 320 may be made from at least one material selected from a group comprising plastic, copper, stainless steel, wood, and glass fiber and resin composite.

Linear element 322 may be any element that couples spindle 320 to anchor 304. In one embodiment of the present arrangements, linear element is a flexible material and is capable of wrapping and/or unwrapping around spindle 320. By way of example, linear element 322 may be at least one flexible component selected from a group comprising band, strap, cord, cable, and chain. Linear element 322 may be made from at least one material selected from a group comprising stainless steel, plastic, glass fibers and resin, natural and/or synthetic braided fibers. In a preferred embodiment of the present arrangements, linear element is a stainless steel band.

Anchor 304, in one embodiment of the present arrangements, includes an arced surface profile that extends between a first linear surface and a second linear surface. The first linear surface is substantially parallel to a surface of hinged panel 310 onto which anchor 304 is coupled and the second linear surface is substantially perpendicular to the surface of hinged panel 310. The arced surface profile extends an arc length spanning from one end, which intersects the first linear surface, to another end, which intersects the second linear surface. As described above, an end of linear element 322 is coupled to spindle 310 and another end is coupled to anchor 304, at the intersection of the first linear surface and the arced surface. A portion of linear element 322 is disposed adjacent to the arced surface profile and extends an extending length that is equivalent to the arced length.

The extending length of linear element 322, in one embodiment of the present arrangements, is substantially equivalent to a length of linear element 322 that wraps or unwraps around spindle 320 to angularly displacing anchor 304 by about 90 degrees. Thus, to pivot hinged panel 310, which is coupled to anchor 304, 90 degrees, spindle 320 wraps or unwraps the extending length of linear element 322.

While not wishing to be bound by theory, the arced length is substantially equivalent to one quarter of a circumference of a circle or $\frac{1}{2}\pi r$, where "r" represents a radius of the circle. In one embodiment of the present arrangements, the arced surface of anchor 304 has a radius value that ranges from about 0.5 inches to about 6 inches. In a preferred embodiment of the present arrangements, the arced surface has a radius value that ranges from about 0.75 inches to about 4 inches. In a more preferred embodiment of the present arrangements, the arced surface has a radius value that ranges from about 1.5 inches to about 2.25 inches.

In a preferred embodiment of the present arrangements, a radius of the arced surface of anchor 304 is greater than a radius of spindle 320. Again, while not wishing to be bound by theory, when the radius of the arced surface is greater than then the radius of spindle 320, a pulley ratio greater than one is achieved. Thus, the larger radius of the arced surface profile increases the operative torque at anchor 304.

As a result, gear motor 306 does not have to generate an operative torque value that is achieved at anchor 304. Instead, gear motor 306 generates an operative torque value that is less than the operative torque value at anchor 304. In this preferred arrangement, hinged-panel opening and closing system 300 uses a lower cost gear motor 306 that generates a requisite amount of power using a lower operative torque.

To prevent damage or injury to hinged-panel opening and closing system 300, an object and/or a user, linear element 322 and spindle 320 are substantially enclosed within a housing 330. Moreover, in one embodiment of the present arrangements, a portion of anchor 304 extends beyond a proximate edge of hinged panel 310 and the first linear surface of anchor 304 is adjacent to an anchor aperture defined within housing 330. In a more preferred embodiment of the present arrangements, a portion of anchor 304 extends beyond the proximate end of hinged panel 310 and the first linear surface is disposed within an anchor aperture defined within housing 330. In both embodiments, an object or a user is not able to gain entry into housing 330, which minimizes potential injury or damage to the object, user, or hinged-panel opening and closing system 300.

In one embodiment of the present arrangements, hinged-panel opening and closing system 300 further includes a gear motor shaft (e.g., gear motor shaft 636 of FIG. 6) that is coupled, at one end, to gear motor 306 and coupled, at another end, to movement-enabling shaft 326. An opening and/or closing motion generated gear motor 306 is conveyed, through the gear motor shaft, to movement-enabling shaft 326. In another embodiment of the present arrangements, movement-enabling shaft 326 is the gear motor shaft. In other words, the gear motor shaft and movement-enabling shaft 326 are a single shaft.

In yet another embodiment of the present arrangements, spindle 320 surrounds an outside portion of movement-enabling shaft 326. Thus, movement-enabling shaft 326 includes spindle 320. When movement-enabling shaft 326 performs an opening motion or a closing motion, spindle 320, which surrounds movement-enabling shaft 326, also performs an opening motion and/or closing motion. Spindle 320, in another embodiment of the present arrangements, is distinct from movement-enabling shaft 326. By way of example, another shaft end (opposite to the end that connects to gear motor 306) of movement-enabling shaft 326 is coupled to at least a spindle end of spindle 320. The opening motion or closing motion of movement-enabling shaft 326 is conveyed to spindle 320.

Hinged-panel opening and closing system 300, in one embodiment of the present arrangements, includes a switch 324, which is communicatively coupled to gear motor 306. When switch 324 is activated, gear motor 306 ceases an opening motion of movement-enabling shaft 326 and/or switches from an opening motion to a closing motion. In one implementation of the present arrangements, switch 324 is activated when anchor 304 contacts switch 324. Preferably, anchor 304 contacts switch 324 when hinged panel 310 is opened to a predetermined open position.

In one embodiment of the present arrangements, hinged-panel opening and closing system 300 includes a bumper 328, which converts a rotational displacement of anchor 304 to a displacement of bumper 328 in a linear direction. Disposed between switch 324 and anchor 304, bumper 328 receives contact from anchor 304 and transmits the contact to switch 324. Bumper 328 may be included to act as a spacer between anchor 304 and switch 324. During an operational state of bumper 326, the rotational displacement of anchor 304 contacts bumper 328 and bumper 328 flexes or bends (in a linear direction) towards switch 324 until bumper 328 contacts switch 324.

Gear motor 306, movement-enabling component 302, spindle 320, switch 324, bumper 328, and at least a portion of linear element 322 are disposed within housing 330, which is coupled to supporting structure 308.

FIGS. 1A, 1B, 2, and 3 illustrate hinged-panel opening and closing systems for displacing a hinged panel relative to a receiving structure. During operation of the hinged-panel opening and closing systems, however, a foreign object (e.g., a person or animal) may obstruct displacement of the hinged panel. Specifically, the presence of the foreign object obstructs or impedes the displacement of the hinged panel away from the receiving structure.

The present arrangements and teachings provide novel hinged-panel opening and closing systems that, in presence of a foreign object (e.g., a person or animal) that obstructs displacement of the hinged panel, automatically inhibits displacement of the hinged panel or reverses displacement of the hinged panel. The present arrangements provide novel safety systems that impede displacement of the hinged panel and/or reverses displacement of the hinged panel when the foreign object obstructs displacement of the hinged panel. As discussed above, these novel safety systems minimize or prevent damage to the hinged-panel opening and closing systems, the foreign object, the supporting structure, and/or the hinged door.

In the absence of the novel safety systems that impede displacement of the hinged panel and/or reverses displacement of the hinged panel, a gate or door opening system will continue to attempt displacement of the gate or door even when a foreign object impedes or prevents displacement. By way of example, if an obstructing object prevents displacement of the gate or door, a motor continues to receive a voltage to displace the gate or door. However, the obstructing object prevents the motor from displacing the gate or door causing the gear motor to reach its stall torque. A stalled gear motor causes gear motor overheating and/or premature gear motor failure. The obstruction may also cause damage to the hinged-panel opening and closing system, the foreign object, the supporting structure, and/or the door.

Figure 4A:
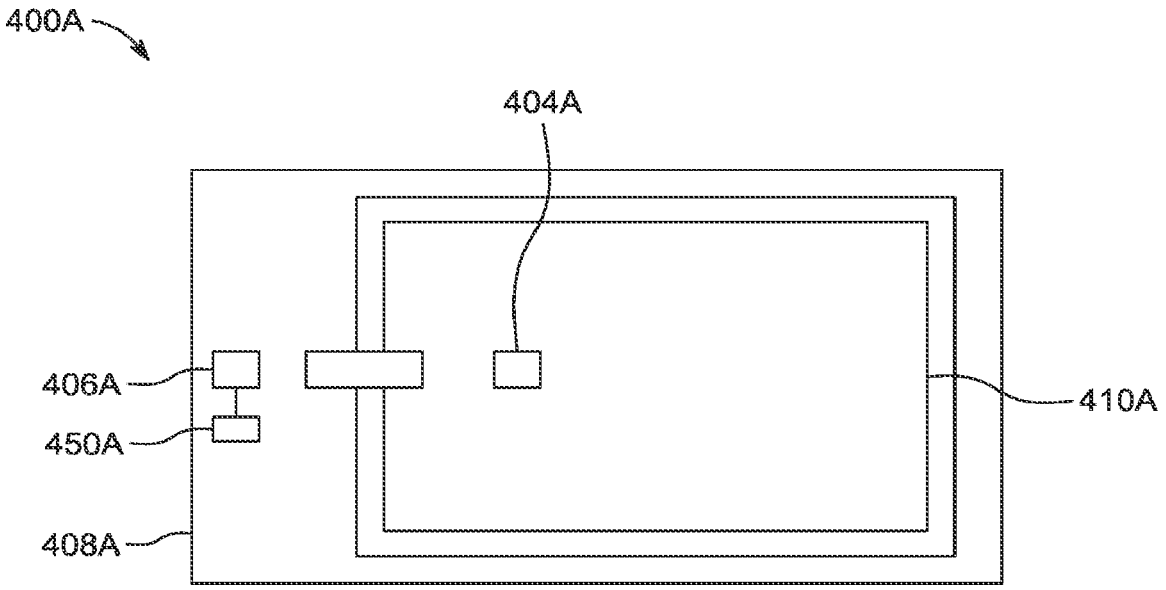
FIG. 4A shows a frontal view the hinged-panel opening and closing system, according to one embodiment of the present arrangements, shown in FIG. 1A and that includes an electronic hinged-panel displacement regulator that regulates, using a circuit, power to a gear motor to impede or stop pivoting of a hinged panel.

FIG. 4A shows a hinged-panel opening and closing systems 400A, according to one embodiment of the present arrangements, that includes an electronic hinged-panel displacement regulator 450A. Hinged-panel opening and closing systems 400A includes a movement-enabling component 402A, an anchor 404A, a gear motor 406A (that is disposed on supporting structure 408A), which are substantially similar to movement-enabling component 102A, anchor 104A, and gear motor 106A of FIG. 1A, respectively. Electronic hinged-panel displacement regulator 450A provides an electronic safety system for impeding or stopping displacement of hinged panel 410A. Electronic hinged-panel displacement regulator 450A, which is communicatively coupled to gear motor 406A, regulates displacement of hinged panel 410A via electronic communication to gear motor 406A. In other words, to regulate displacement of hinged panel 410A, electronic hinged-panel displacement regulator 450A provides electronic instructions which causes gear motor 406A to impede an opening motion and/or to perform a closing motion of hinged panel 410A.

Hinged-panel opening and closing systems 400B is substantially similar to hinged-panel opening and closing systems 400A except that a physical hinged-panel displacement regulator 450B physically regulates displacement of the hinged panel 410B. Hinged-panel opening and closing systems 400B includes a movement-enabling component 402B, an anchor 404B, a gear motor 406B (that is disposed on supporting structure 408B). Physical hinged-panel displacement regulator 450B provides a physical safety system for impeding or stopping displacement of hinged panel 410B. In this embodiment, physical hinged-panel displacement regulator 450B is coupled to gear motor 406B and movement-enabling component 402B. Physical hinged-panel displacement regulator 450B regulates conveyance of an opening motion from gear motor 406B to movement-enabling component 402B. In one embodiment of the present arrangements, physical hinged-panel displacement regulator 450B is a frictional contact between a first frictional surface and a second frictional surface.

Figure 5:
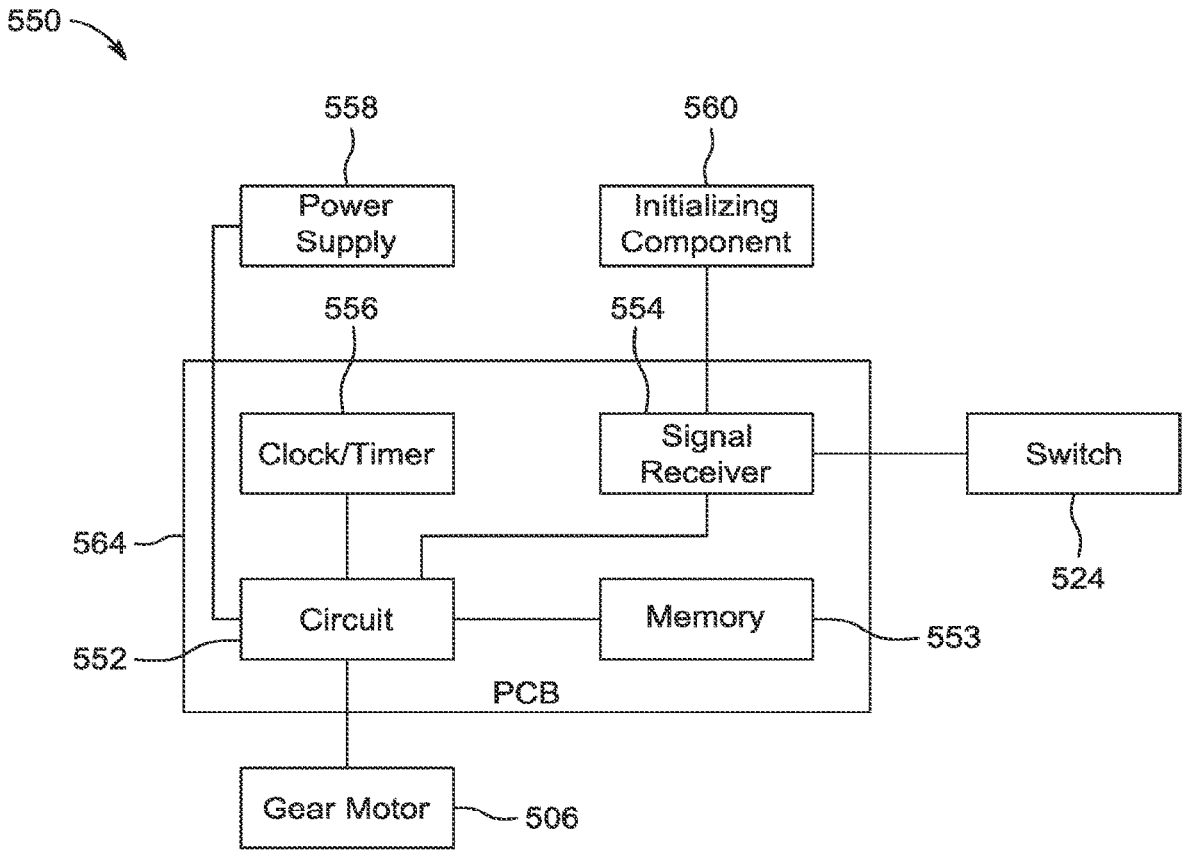
FIG. 5 shows a block diagram of the electronic hinged-panel displacement regulator, according to one embodiment of the present arrangements, of FIG. 4A.

FIG. 5 shows an electronic hinged-panel displacement regulator 550, according to one embodiment of the present arrangements, that is substantially similar to electronic hinged-panel displacement regulator 450A of FIG. 4A. Electronic hinged-panel displacement regulator 550 is communicatively coupled to a gear motor 506. Electronic hinged-panel displacement regulator 550 includes a circuit 552 that is communicatively coupled to a memory 553, a signal receiver 554, and a clock/timer 556, each of which is disposed on a printed circuit board 564.

Circuit 552, which is coupled to gear motor 506 at one end and a power supply 558 at another end, regulates how much voltage and/or current is supplied, from power supply 558, to gear motor 506 to enable displacement of an anchor (e.g., anchor 304 of FIG. 3) in one direction or a reverse direction. During one operational state of electronic hinged-panel displacement regulator 550, circuit 552 measures draw of current by gear motor 506 and compares the draw of current to a predefined current draw value for a predefined duration of time.

The predefined current draw value is a value of current gear motor 506 may draw to generate an operative torque. While not wishing to be bound by theory, the present teaching recognizes that current draw of gear motor 506 increases in proportion to an opposing torque applied to a spindle that is coupled to gear motor 506. In other words, as the opposing torque on the spindle increases, gear motor 506 draws a proportion increase in current to allow gear motor to generate the operative torque. Thus, in a preferred embodiment of the present arrangements, the predefined current draw value correlates to a predefined opposing torque acting on a spindle. The predefined duration of time is a duration of time in which the current draw value of gear motor 506 equals or exceeds the predefined current draw value. The predefined current draw value ranges from between about 0.5 amps to about 10 amps. In a preferred embodiment of the present arrangements, the predefined current draw value ranges from about 0.75 amps to about 7 amps. In a more preferred embodiment of the present arrangements, the predefined current draw value ranges from about 1 amp to about 2 amps. In one implementation of the present arrangements, the predefined current draw value is about 2 amps and the predefined duration of time is about 0.5 seconds.

In one implementation of the present arrangements, if the draw of current of gear motor 506 is less than the predefined current draw value (i.e., an opposing torque acting on the spindle is less than a predefined opposing torque value) for a predefined duration of time, circuit 552 distributes an opening voltage and/or current, from power supply 558, to gear motor 506. The opening voltage generates, through gear motor 506, an operative torque at a spindle (e.g., spindle 320 of FIG. 3), which enables rotational displacement of the anchor in one direction.

If, however, gear motor 506 draw of current is equal to or greater than the predefined current draw value for a predefined duration of time, an opposing torque that is greater than an operative torque is acting on the spindle. In other words, a foreign object is obstructing or impeding displacement of the anchor, which is generating the opposing torque on the spindle. In this operative state, circuit 552 directs a closing voltage and/or current, from power supply 558, to gear motor 506 and/or restricts the opening voltage and/or current. The closing voltage and/or current generates a closing torque at the spindle, which enables rotational displacement of the anchor in a reverse direction.

Memory 553, which is coupled to circuit 552 stores the predefined current draw value and the predefined duration of time value. In one implementation of the present arrangements, memory 553 also stores one or more measured gear motor draw of current values.

Signal receiver 554 receives a signal from initializing component 560 and/or switch 524. In one embodiment of the present arrangements, the signal is an initializing signal to displace a distal end (e.g., distal end 216 of FIG. 2) of a hinged panel away from a receiving structure (e.g., receiving structure 218 of FIG. 2). In another embodiment of the present arrangements, signal receiver 554 receives an impeding signal to displace the distal end of the hinged panel towards the receiving structure. Signal receiver transmits the initializing signal or the impeding signal to the circuit 552, which regulates voltage and/or current supplied to gear motor 506.

Signal receiver 554 may be wired or wirelessly coupled to initializing component 560 and switch 524, respectively. Wireless communication may be implemented using one or more interface/protocols such as, for example, Wi-Fi, Bluetooth, WiMAX, cellular telephone networks, radio frequency (e.g., RFID), and/or Infrared and Near Field Magnetics.

Initializing component 560 may be any component that generates the initializing signal for a hinged-panel opening and closing system to displace the hinged panel relative to the receiving structure. In one embodiment of the present arrangement, initializing component is a button or toggle switch.

Switch 524 may be any component that generates an impeding signal for hinged-panel opening and closing system to impede an opening motion of a hinged panel and/or perform a closing motion of the hinged panel. In one embodiment of the present arrangements, switch 524 is snap-action switch.

In one embodiment of the present arrangements, at least one of memory 553, signal receiver 554, and clock/timer 556 is integrated into circuit 552. In another embodiment of the present arrangements, at least one of circuit 552, memory 553, signal receiver 554, and clock/timer 556 are not disposed on printed circuit board but is communicatively coupled to printed circuit board 564. In yet another embodiment of the present arrangements, electronic hinged-panel displacement regulator 550 does not include printed circuit board 564.

Clock/Timer 556 may be a clock and/or a timer. If clock/timer 556 is a clock then upon activation, clock/timer 556 begins measuring time from a starting time value of zero. If clock/timer 556 is a timer, upon activation, clock/timer 556 begins counting down time from a predefined time value to zero. In a preferred embodiment of the present arrangements, clock/timer 556 is a timer and upon activation, when circuit 552 receives an activating signal from signal receiver 554, clock/timer 556 counts down from about 30 seconds.

Figure 4B:
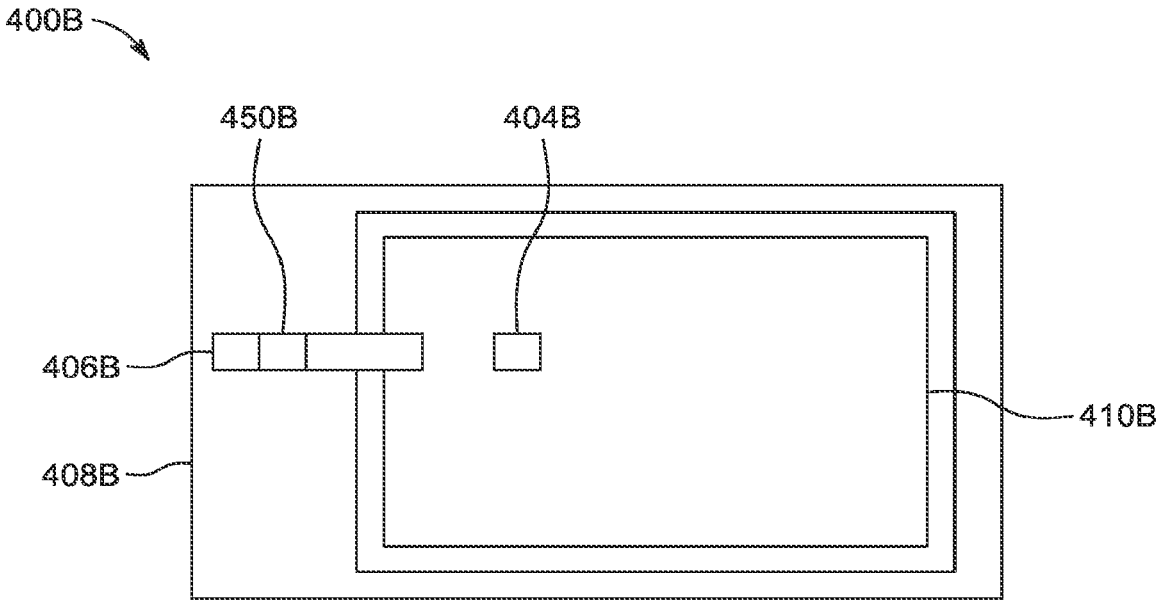
FIG. 4B shows a frontal view the hinged-panel opening and closing system, according to another embodiment of the present arrangements, shown in FIG. 1A and that includes a physical hinged-panel displacement regulator that regulates, using frictional contact, an opening motion of a movement-enabling shaft to impedes or stop pivoting of a hinged panel.
Figure 6:
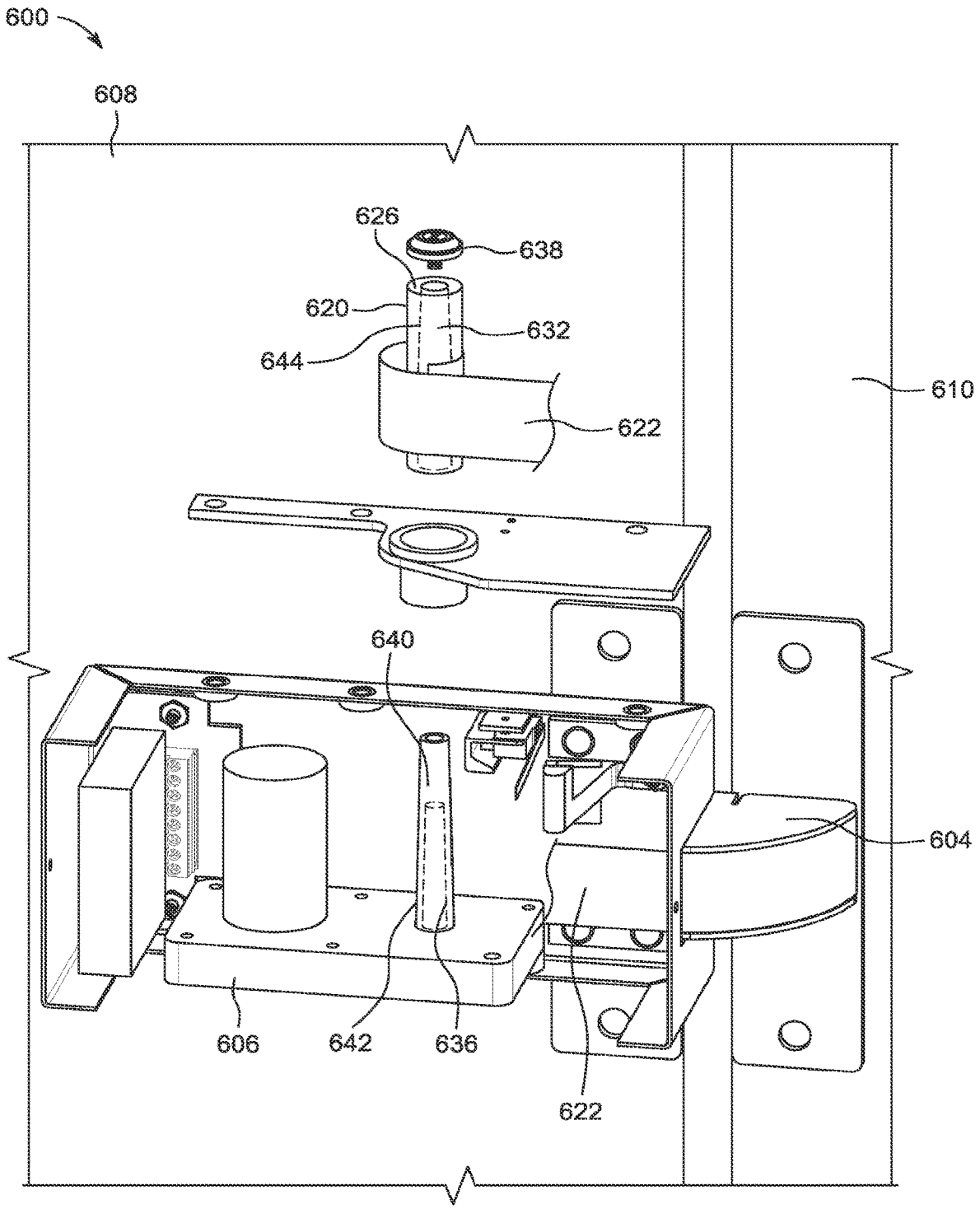
FIG. 6 shows the hinged-panel opening and closing system, according to one embodiment of the present arrangements, of FIG. 4B and wherein the physical hinged-panel displacement regulator is a frictional contact between a contact surface of a protruding component and complementary surface of a conical shaped cavity.

FIG. 6 shows a hinged-panel opening and closing system 600, according to one embodiment of the present arrangements, that is substantially similar to hinged-panel opening and closing systems 400B of FIG. 4B. Hinged-panel opening and closing system 600 includes a physical hinged-panel displacement regulator that physically regulates displacement of the hinged panel 610 relative to a receiving structure (i.e., receiving structure 218 of FIG. 2). The hinged-panel displacement regulator is a frictional contact between a first frictional surface (i.e., contact surface 642) and a second frictional surface (i.e., complementary surface 644).

In addition to an anchor 604, a gear motor 606, and a linear element 622, hinged-panel opening and closing system 600, includes a gear motor shaft 636, which is coupled to gear motor 606 on one end, and coupled, on another end, to a protruding component 640. A contact surface 642, which is an exterior surface of protruding component 640, is the first frictional surface.

A movement-enabling shaft 626 is coupled to a receiving component, which includes a conical-shaped cavity 632. A complementary surface 644, which is the interior surface of conical-shaped cavity 632, is the second frictional surface. Moreover, an outside portion of movement-enabling shaft 626 includes spindle 620.

In an assembled state, at least a portion of protruding component 640 occupies conical-shaped cavity 632 and contact surface 642 and the complementary surface 644 contact to form the frictional contact. A magnitude of frictional contact (i.e., a friction force) may be adjusted by friction force adjuster 638. In one implementation of the present arrangements, friction force adjuster 638 includes a fastener that extends through an aperture defined within a top surface of movement-enabling shaft 626 and fastens to a top surface of protruding component 640. If the fastener is tightened, contact surface 642 of protruding component 640 is compressed against complementary surface 644 of conical-shaped cavity 632 and increases a friction force of the frictional contact. In another implementation of the present arrangements, friction force adjuster 638 includes a fastener, a first washer, a compression spring (e.g., an elastomer compression spring), and a second washer. The first washer, compression spring and second washer isolate the fastener from rotational movement of movement-enabling shaft 626. The first washer is disposed adjacent to the fastener, the second washer is disposed adjacent to the top surface of movement-enabling shaft 626, and the compression spring is sandwiched between the first washer and the second washer. The fastener extends through apertures defined within the first washer, compression spring, second washer, respectively, and through the aperture defined within a top surface of movement-enabling shaft 626.

A rotational motion of gear motor shaft 636 generates an imparting torque at contact surface 642. In one implementation of the present arrangements, the imparting torque is restricted by the frictional force of the frictional contact to produce a restricted torque at the complementary surface 644. If an opposing torque, generated from an external force at spindle 620, is less than the restricting torque, the imparting torque will be conveyed to complementary surface 644 to produce a restricted torque at complementary surface 644. The restricted torque is conveyed, through movement-enabling shaft 626, to spindle 620. However, if the opposing torque is greater than or equal to the restricted torque, the imparting torque will not be conveyed to the second frictional surface. Rather, gear motor shaft 636, which is coupled to contact surface 642, will rotate and movement-enabling shaft 626, which is coupled to complementary surface 644, will not.

Figure 7:
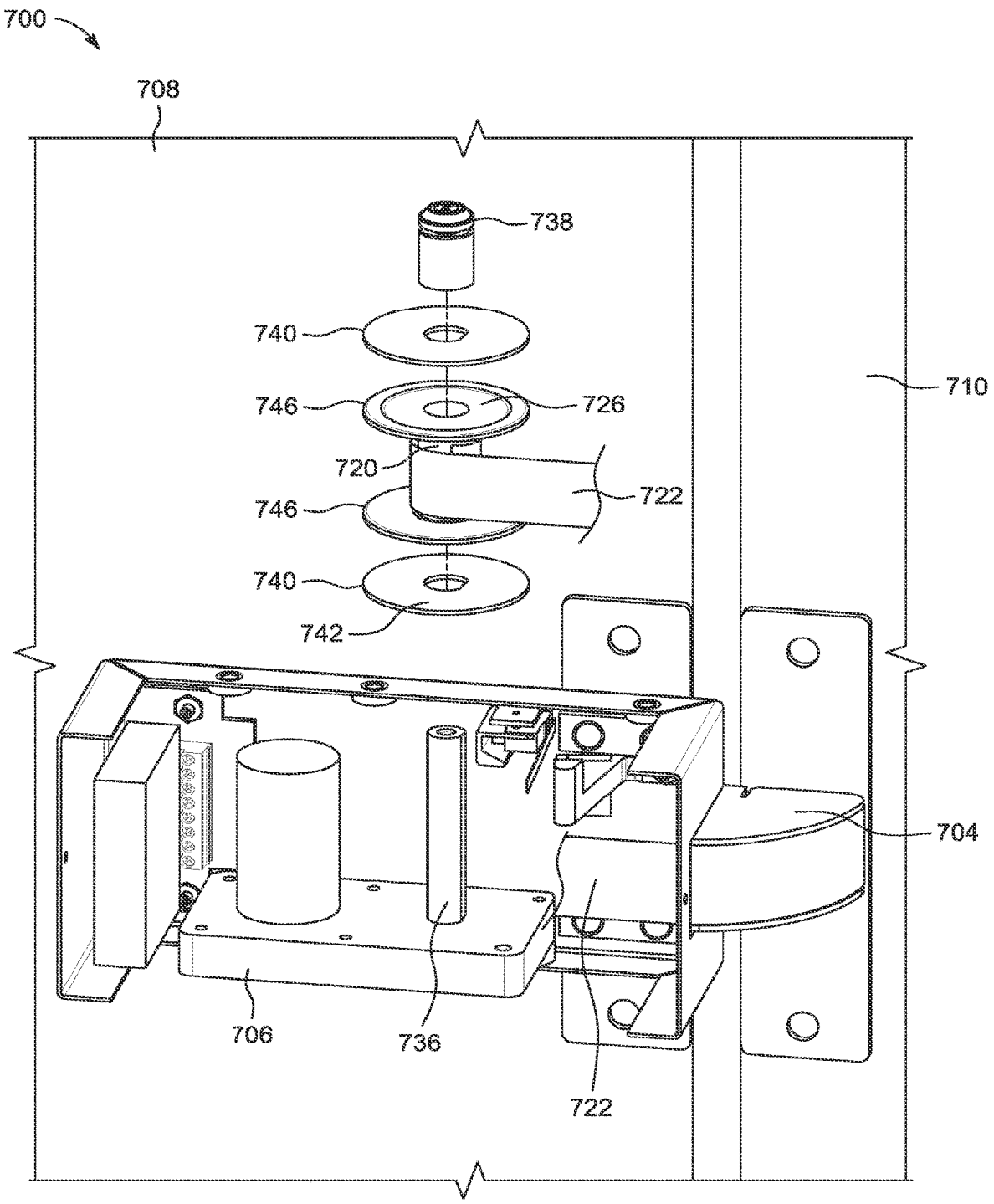
FIG. 7 shows the hinged-panel opening and closing system, according to another embodiment of the present arrangements, of FIG. 4B and wherein the physical hinged-panel displacement regulator is a frictional contact between a contact surface of a supporting disc and complementary surface of a rotating disc.

FIG. 7 shows a hinged-panel opening and closing system 700, according to one embodiment of the present arrangements, that is substantially similar to hinged-panel opening and closing system 600 of FIG. 6, except the hinged-panel displacement regulator is a frictional contact between two adjacent discs. In this embodiment, hinged-panel opening and closing system 700 includes a gear motor 706, an anchor 704, a supporting structure 708, a hinged panel 710, a spindle 720, a linear element 722, a gear motor shaft 736, and friction force adjuster 738 which are substantially similar to their counterparts in FIG. 6 (i.e., gear motor 606, anchor 604 supporting structure 608, hinged panel 610, spindle 620, linear element 622, gear motor shaft 636, and friction force adjuster 638, respectively).

Gear motor shaft 736 is coupled to a rotating disc 740, which includes a complementary surface 742. A second frictional surface is complementary surface 742. A movement-enabling shaft 726 is coupled spindle 720 and coupled to a supporting disc 746, which includes contact surface (not shown in FIG. 7) that is adjacent to complementary surface 742. A first frictional surface is the contact surface of supporting disc 746.

In an assembled state, the contact surface and complementary surface 742 contact to form a frictional contact. As discussed above, an imparting force received at complementary surface 742 of rotating disc 740 is restricted by the frictional contact to produce a restricted torque at the contact surface of supporting disc 746. When an opposing torque, originating from spindle 720, is equal or greater than the restricted torque, gear motor shaft 736 moves in one direction and movement-enabling shaft 726 does not move and/or moves in a second direction that is opposite to the first direction.

In a preferred embodiment of the arrangements shown in FIG. 6 and FIG. 7, the restricted toque is less than a predefined stall torque of gear motor 606 and 706, respectively. Thus, in an activated state of gear motor 606 or 706 and in the presence of an opposing torque, the frictional contact between the contact surface and the complementary surface allows gear motor 606 and 706 to continue to rotate gear motor shaft 636 and 736, respectively. Gear motor 606 and 706 is not subject to a state of operation where gear motor 606 and 706 is stalled, which, as discussed above, may cause premature failure or damage to gear motor 606 and 706.

Figure 8:
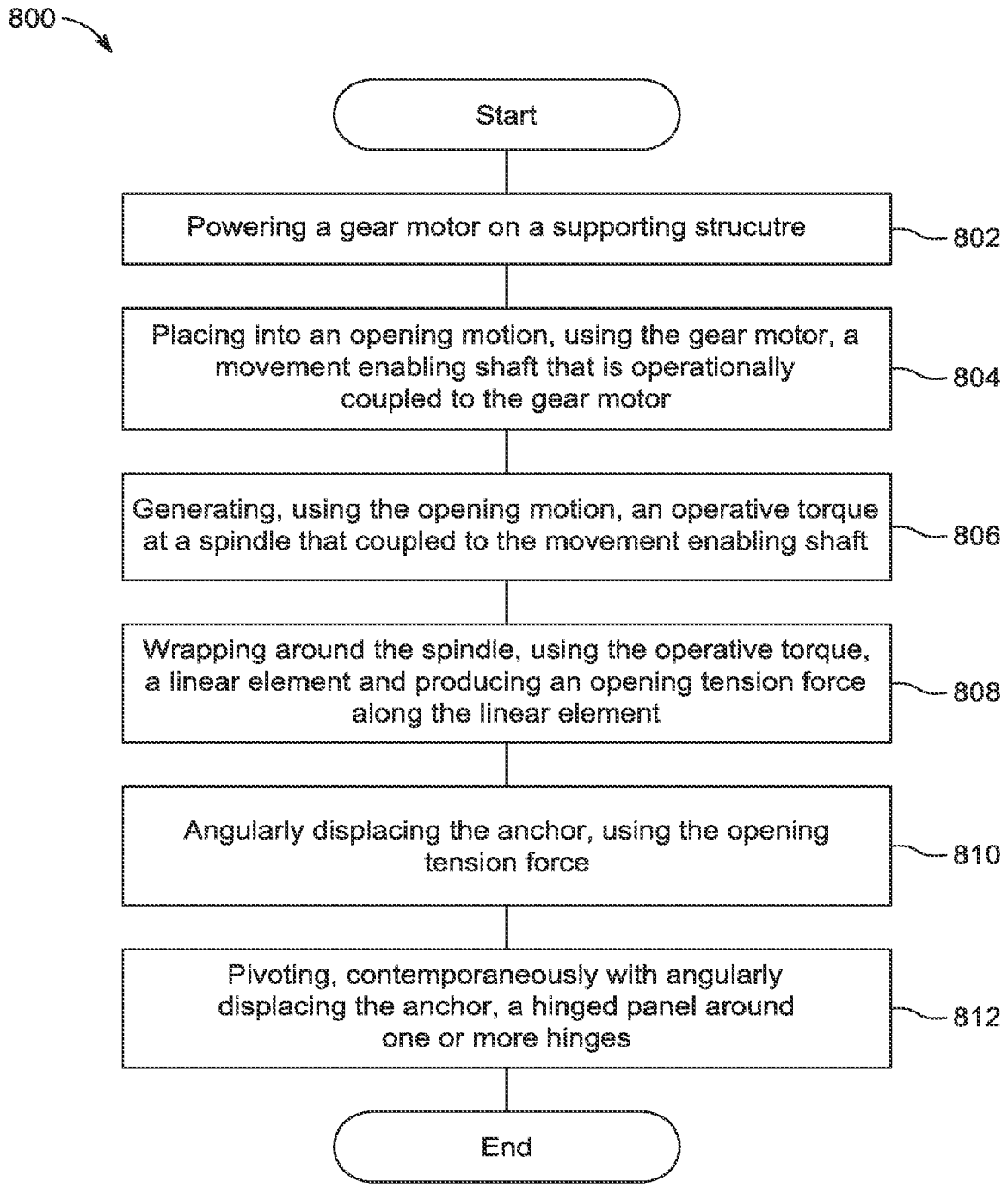
FIG. 8 shows a flowchart detailing steps for a method, according to one embodiment of the present teachings, that is capable of pivoting a hinged panel around hinges.

The present teaching offer, among other things, different methods of pivoting a hinged panel that need not rely on the above-mentioned structural features and components. FIG. 8 shows a method of pivoting a hinged panel, according to one embodiment of the present teachings. Method 800 begins with a step 802, which includes powering a gear motor (e.g., gear motor 106A of FIG. 1A) on a supporting structure (e.g., supporting structure 108A of FIG. 1A). In one implementation of the present teachings, a circuit (e.g., circuit 552 of FIG. 5) regulates distribution of voltage, from a power supply (e.g., power supply 558 of FIG. 5), to the gear motor. Thus, in step 802, the circuit distributes an opening voltage, from the power supply, to power the gear motor.

A step 804 includes placing into an opening motion, using the gear motor, a movement-enabling shaft (e.g., movement-enabling shaft 326 of FIG. 3) that is operationally coupled to the gear motor. In one implementation of the present teachings, one end of the movement-enabling shaft is coupled to the gear motor to enable the movement-enabling shaft to perform the opening motion. In another implementation of the present arrangements, the hinged-panel opening and closing system includes a gear motor shaft (e.g., gear motor shaft 636 and 736 of FIGS. 6 and 7, respectively) that is coupled, at one end, to the gear motor and at another end to the movement-enabling shaft. The gear motor operates, through the gear motor shaft, to enable the movement-enabling shaft to perform the opening motion.

Next a step 806, includes generating, using the opening motion, an operative torque at a spindle (e.g., spindle 320 of FIG. 3) that is coupled to the movement-enabling shaft. The spindle, like the gear motor is coupled to the supporting structure. In one embodiment of the present teachings, the spindle is coupled to another end of the movement-enabling shaft and in another embodiment of the present teaching, the spindle surrounds the movement-enabling shaft. In both embodiments, the opening motion is conveyed to the spindle, which generates the operative torque. Preferably, the operative torque is at an external surface (e.g., external surface 334 of FIG. 3) of a cylindrical-shaped spindle.

Following the step 806, a step 808 is implemented and includes wrapping around the spindle, using the operative torque, a linear element (e.g., linear element 322 of FIG. 3). In one implementation of the present teachings, the linear element is coupled, at one end, to the spindle, and is coupled, at another end, to an anchor (e.g., anchor 104A of FIG. 1A). The linear element extends an extending distance between the spindle and the anchor. As the spindle rotates in the opening motion, the operative torque pulls the end of the linear element around the circumference of the spindle, causing the linear element to wrap around the spindle. As the linear element wraps around the spindle, the extending distance of the linear element, between the spindle and the anchor, diminishes.

Step 808 further includes producing an opening tension force along the linear element. The operative torque generates, at a contact point between the linear element and an external surface of spindle, a pulling force. The pull force is perpendicular to a radius of the spindle defined between the spindle center point and the contact point. The direction of the pull force is same direction as the rotation of the spindle. An opening tension force, that is in an opposite direction as the pull force, extends along the extending distance of linear element. At the anchor, the opening tension force is directed, along the linear element, in a direction towards the spindle and away from the anchor.

Next, a step 810 includes angularly displacing the anchor, using the opening tension force. The opening tension force at the anchor angularly displaces the anchor towards the spindle. As the anchor is angularly displaced, the extending distance of the linear element between the spindle and the anchor diminishes. The rotating spindle wraps the linear element around the exterior surface to keep the linear element, between the spindle and anchor, in tension.

A step 812 includes pivoting, contemporaneously with angularly displacing the anchor, the hinged panel to produce an opening motion of the hinged panel. In a preferred embodiment of the present teachings, the anchor is secured on the hinged panel, which disposed between the supporting structure and a receiving structure. The hinged panel pivots around one or more hinges disposed between and coupled to the supporting structure of the hinged panel. Moreover, the opening motion of the hinged panel displaces the hinged panel away from the receiving structure.

In one embodiment of the present teachings, method 800 includes a receiving step that includes receiving, at a signal receiver (e.g., signal receiver 554 of FIG. 5) that is coupled to the gear motor, an initializing signal to initiate powering of the gear motor. Preferably, the initializing signal is received from an initializing component (e.g., initializing component 560 of FIG. 5). In one implementation of the present teachings, the receiving step occurs before step 802 of powering a gear motor.

In another embodiment of the present teachings, step 802 includes a step of distributing, using a circuit, an opening voltage from the power supply to the gear motor.

In another embodiment of the present teachings, step 802 of powering the gear motor further includes activating a clock/timer (e.g., clock/timer 556 of FIG. 5) to measure a hinged panel opening duration, during which the hinged panel moves from a closed position to an opening position. Upon completion of the hinged panel opening duration, the hinged panel is returned to the closed position. In one embodiment of the present teachings, the clock/timer is a timer and begins a countdown contemporaneously with powering the gear motor. In a preferred embodiment of the present teachings, the timer counts down about 30 seconds.

Step 804 of placing the movement-enabling shaft into the opening motion, in one implementation of the present teachings, includes placing into motion a gear motor shaft, coupled, on one end, to the gear motor and coupled, at another end, to the movement-enabling shaft. In this configuration, the gear motor operates through the gear motor shaft to enable the placing the movement-enabling shaft into the opening motion.

Step 808 of wrapping around the spindle, in one implementation of the present teachings, includes wrapping an extending length of the linear element around the spindle to angularly displace the anchor by about 90 degrees. The extending length is equivalent to an arced length, which is a length of an arced surface profile defined on the anchor. The arced surface profile extends from one arc end to another arc end and the linear element extends over the arced surface profile.

Method 800, in one implementation of the present teachings, further includes a step of receiving, at the spindle, an external force that does originate from the gear motor. The external force on the spindle may be caused, for example, by a foreign object that obstructs displacement of the hinged panel relative to the receiving structure. The obstructing foreign object generates the external force, at the spindle, along the linear element that is in an opposite direction of the opening tension force.

Another step includes translating the external force, received at the spindle, to an opposing torque. The opposing torque is a product of the external force and a radius of the spindle. The opposing torque operates in a direction that is opposite to the operative torque that is generated by the gear motor. If the magnitude of the opposing torque is greater than or equal to the operative torque, an impeding step may be carried out. In one embodiment of the present impeding step, the opening motion of the hinged panel is impeded by applying a holding voltage to a gear motor or a closing motion of the hinged panel is enabled by generating a closing motion on the movement-enabling shaft. As mentioned before, the closing motion of the movement-enabling shaft, which is in a direction opposite to the opening motion of the movement-enabling shaft, unwraps the linear element from the spindle and allows displacement of the hinged panel towards the receiving structure.

In one implementation of the present teachings, the impeding step includes using an electronic hinged-panel displacement regulator (e.g., hinged-panel displacement regulator 450A), to impede the opening motion or perform the closing motion.

Electronic hinged-panel displacement regulator 450A generates the closing motion of the movement-enabling shaft in a series of steps that begins by carrying out a measuring step. This step includes a step of measuring, using the circuit, a draw of current by the gear motor. Next, the circuit compares the amount of current drawn to a predefined value of amount of current drawn for a predefined value of time duration. Together, the predefined current draw value and the predefined duration of time value correspond to the opposing torque acting on the spindle. In this implementation of the present teachings, the circuit retrieves, from memory (e.g., memory 553 of FIG. 5), the predefined current draw value and the predefined duration of time value.

If the amount of current drawn equals to or exceeds the predefined value of amount of current drawn for the predetermined value of time duration, the impeding step carries out a directing step. In this directing step, the circuit directs a closing voltage to the gear motor. The closing voltage is a magnitude of voltage that is applied to the gear motor to generate the closing motion of the movement-enabling shaft. The spindle receives the closing motion and generates a closing torque, which unwraps the linear element from the spindle. The unwrapped linear element is no longer experiencing the opening tension force. Thus, the hinged panel, which is coupled to the linear element at another end, may be displaced to the closed position (i.e., the hinged panel is on the same linear plane as the receiving structure.

In an alternative embodiment implementation of the present teachings, the directing step includes directing the closing voltage to the gear motor for a predefined duration of closing time to displace the hinged panel to the closed position. This is preferably carried out by the circuit of electronic hinged-panel displacement regulator 450A.

In those instances where the impeding step impedes the opening motion of the movement-enabling shaft, a directing step is carried out. The directing step includes directing, using the circuit, a holding voltage to the gear motor for a duration of time. The holding voltage holds the movement-enabling shaft in a stationary position. In other words, the movement-enabling shaft does not rotate. The duration of time, in one embodiment of the present teachings, is any time remaining from the predetermined timer duration of time (e.g., thirty seconds). After the duration of time, the circuit directs a closing voltage to gear motor to return the hinged panel to a closed position.

In yet another implementation of the present arrangements, the impeding step uses a physical hinged-panel displacement regulator (e.g., physical hinged-panel displacement regulator 450B of FIG. 4B). The physical hinged-panel displacement regulator, in one embodiment of the present teachings, is a frictional contact between a first frictional surface and a second frictional surface. The first frictional surface, in one implementation of the present teachings, is a contact surface (e.g., contact surface 642 of FIG. 6) of a protruding component (e.g., protruding component 640 of FIG. 6) and the second frictional surface is a complementary surface (e.g., complementary surface 644), of a conical-shaped cavity (e.g., conical-shaped cavity 632 of FIG. 6). In another implementation of the present teachings, the first frictional surface is a contact surface of a supporting disc (e.g., a supporting disc 746 of FIG. 7) and the second frictional surface is complementary surface (e.g., complementary surface 742 of FIG. 7) of a rotating disc (e.g., rotating disc 740 of FIG. 7).

The physical displacement regulator generates the closing motion of the movement-enabling shaft in a series of steps beginning with a rotating step. The rotating step includes rotating, using an opening motion of the gear motor shaft, a first friction surface. In this step, the gear motor shaft is coupled to the first frictional surface.

The impeding step then proceeds to a generating step. In this step, the rotating first frictional surface generates an imparting torque at the first frictional surface.

Next a frictional contact step is carried out. The frictional contact step includes creating a frictional contact between the first frictional surface and a second frictional surface. Preferably, the second frictional surface is coupled to one end of a movement-enabling component and another end of the movement-enabling shaft is coupled to a spindle.

Following the frictional contact step, a restricting step is implemented, which includes restricting, using the frictional contact, the imparting torque of the frictional surface to produce a restricted torque at the second frictional surface.

Finally, the restricted torque is translated to the opening motion the movement-enabling shaft. In presence of the opposing torque, acting on the spindle, that is equal to or greater than the restricted torque, the gear motor shaft rotates in a first direction (e.g., rotates in an opening motion) and the movement-enabling shaft does not rotate or rotates in a second direction (e.g., rotates in a closing motion) that is opposite to the first direction. By way of example, when the spindle receives an opposing torque that is greater than or equal to a restricted torque, the spindle does not rotate or rotates in closing motion. The gear motor shaft, which is coupled to the gear motor, however, will continue to rotate in an opening motion.

In one embodiment of the present teachings, a closing mechanism (e.g., a torsion spring coupled to the supporting structure and the hinged panel) is used to angularly displace the hinged panel to the closed position. To this end, the method 800 further includes steps to angularly displace the hinged panel to the closed position beginning with an applying step. The applying step includes applying, using the closing mechanism (e.g., a torsion spring coupled to the supporting structure and the hinged panel), a closing external torque on the spindle. In this step, the closing mechanism generates a closing external force on the hinged panel. This closing external force is transferred, through the linear element, to the exterior surface of the spindle. At the spindle, the closing external force generates the closing external torque.

Following the applying step, an unwrapping step is carried out. The unwrapping step includes unwrapping, due to the closing external torque, the linear element around the spindle, which results in a closing force. In other words, the closing external torque cause the spindle to move in a closing direction, which unwraps the linear element around the spindle. As the linear element unwraps, the adjustable length of the linear element, between the spindle and the anchor increases. In one embodiment of the present teachings, the gear motor also causes the spindle to move in a closing motion. This closing motion generates additional closing force to assist in unwrapping of the linear element.

After the unwrapping step, a displacing step is implemented, which includes rotationally displacing the anchor, caused by the closing force, such that the distal end of the hinged panel rotationally displaces towards the receiving structure. The rotational displacement produces a closing motion of the hinged panel. In addition to the closing force resulting unwrapping the linear element around the spindle, the closing external force generated by the closing mechanism also produces the closing motion of the hinged panel.

In another implementation of the present teachings, method 800 further includes instructing the circuit, using a switch, to cease operation of the gear motor when the switch is contacted or pressed. In a preferred implementation of the present teachings, an anchor contacts the switch when a hinged panel is displaced a predetermined distance away from a receiving structure.

Although illustrative embodiments of the present teachings and arrangements are shown and described in terms of solar modules, other modifications, changes, and substitutions are intended. Accordingly, it is appropriate that the disclosure be construed broadly and in a manner consistent with the scope of the disclosure, as set forth in the following claims.

What is claimed is:

1. A method of pivoting a hinged panel, said method comprising:

powering a gear motor on a supporting structure;

placing into an opening motion, using said gear motor, a movement-enabling shaft that is operationally coupled to said gear motor;

generating, using said opening motion, an operative torque at a spindle that coupled to said movement-enabling shaft and said spindle being secured on said supporting structure;

wrapping around said spindle, using said operative torque, a linear element and producing an opening tension force along said linear element, wherein said linear element extending an extending distance between said spindle and an anchor;

angularly displacing said anchor, using said opening tension force, wherein said anchor being secured on said hinged panel that is disposed between said supporting structure and a receiving structure; and pivoting, contemporaneously with said angularly displacing said anchor, said hinged panel around one or more hinges disposed between and coupled to said supporting structure and said hinged panel to produce an opening motion of said hinged panel such that said hinged panel displaces away from said receiving structure.

2. The method of pivoting a hinged panel of claim 1, further comprising receiving, at a signal receiver that is coupled to said gear motor, an initializing signal to initiate said powering of said gear motor.

3. The method of pivoting a hinged panel of claim 1, wherein said powering said gear motor includes distributing, using a circuit, an opening voltage from said power supply to said gear motor.

4. The method of pivoting a hinged panel of claim 1, further comprising:

applying, using a closing mechanism, a closing external torque on said spindle;

unwrapping around said spindle, under action of said closing external torque, said linear element and thereby increasing said adjustable length of said linear element between said spindle and said anchor and resulting in a closing force; and rotationally displacing said anchor, under action of said closing force, such that said distal end of said hinged panel rotationally displaces towards said receiving structure to produce a closing motion of said hinged panel.

5. The method of pivoting a hinged panel of claim 1, wherein said wrapping around said spindle further comprising wrapping an extending length of said linear element around said spindle to angularly displace said anchor by about 90 degrees, and wherein said extending length is equivalent to an arced length, and said arched length is a length of an arced surface profile defined on said anchor that extends from one arc end to another arc end and said linear element extends over said arced surface profile.

6. The method of pivoting a hinged panel of claim 1, wherein said placing into said opening motion said movement-enabling shaft further comprising placing into motion a gear motor shaft, coupled, on one end, to said gear motor and coupled, at another end, to said movement-enabling shaft such that said gear motor operates through said gear motor shaft to enable said placing into said opening motion said movement-enabling shaft.

7. The method of pivoting a hinged panel of claim 6, further comprising:

receiving, at said spindle, an external force not resulting from said gear motor;

translating said external force, received at said spindle, to an opposing torque operating in a direction opposite to said operative torque; and if magnitude of said opposing torque is greater than or equal to said operative torque, then impeding said opening motion or performing a closing motion of said movement-enabling shaft, wherein said closing motion of said movement-enabling shaft is in a direction opposite to said opening motion of said movement-enabling shaft, and said closing motion of said movement-enabling shaft allows said hinged panel to displace towards said receiving structure.

8. The method of pivoting a hinged panel of claim 7, wherein said impeding said opening motion of said movement-enabling shaft includes using a physical hinged-panel displacement regulator and further comprising:

rotating, using said motion of said gear motor shaft, a first friction surface, wherein said gear motor shaft is coupled to said first friction surface;

generating, from said rotating, an imparting torque at said first frictional surface;

creating a frictional contact between said first frictional surface and a second frictional surface that is coupled to movement-enabling component;

restricting, using said frictional contact, said imparting torque of said first frictional surface to produce a restricted torque at said second frictional surface;

translating said restricted torque to said opening motion said movement-enabling shaft; and wherein in presence of said opposing torque that is equal to or greater than said restricted torque, said gear motor shaft rotates in a first direction and said movement-enabling shaft does not rotate or rotates in a second direction that is opposite to said first direction.

9. The method of pivoting a hinged panel of claim 7, wherein said performing a closing motion of said movement-enabling shaft includes using an electronic hinged-panel displacement regulator and further comprising:

measuring, using a circuit, an amount of current drawn by said gear motor;

comparing, using said circuit, said amount of current drawn to a predefined value of amount of current drawn for a predefined value of time duration; and directing, using said circuit, a closing voltage to said gear motor, if said amount of current drawn equals to or exceeds said predefined value of amount of current drawn for said predetermined value of time duration, wherein said closing voltage is a magnitude of voltage that is applied to said gear motor to effect said closing motion of said movement-enabling shaft.

10. The method of pivoting a hinged panel of claim 9, wherein said directing is carried out for a predefined duration of closing time that is a value of time duration taken by said hinged panel to be disposed in a same plane as said receiving structure.

11. The method of pivoting a hinged panel of claim 9, further comprising instructing said circuit, using a switch, to cease operation of said gear motor.

* * * * *